US007114970B2

(12) United States Patent
Head

(10) Patent No.: US 7,114,970 B2
(45) Date of Patent: Oct. 3, 2006

(54) ELECTRICAL CONDUCTING SYSTEM

(75) Inventor: Philip Head, Ascot Berks (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/482,061

(22) PCT Filed: Jun. 26, 2002

(86) PCT No.: PCT/GB02/02933

§ 371 (c)(1),
(2), (4) Date: Jun. 14, 2004

(87) PCT Pub. No.: WO03/001023

PCT Pub. Date: Jan. 3, 2003

(65) Prior Publication Data

US 2004/0242044 A1 Dec. 2, 2004

(30) Foreign Application Priority Data

Jun. 26, 2001 (GB) ..... 0115524.1

(51) Int. Cl.
*H01R 4/60* (2006.01)

(52) U.S. Cl. ..... 439/191

(58) Field of Classification Search ..... 439/190–195; 166/65.1

See application file for complete search history.

(56) References Cited

U.S. PATENT DOCUMENTS 2,153,883 A 4/1939 Foster
3,191,677 A 6/1965 Kinley
3,424,244 A 1/1969 Kinley
3,518,609 A * 6/1970 Fontenot, Jr. ..... 439/191
3,528,498 A 9/1970 Carothers
3,616,868 A 11/1971 Bassinger ..... 175/92
3,696,332 A * 10/1972 Dickson et al. ..... 340/855.1
3,879,097 A 4/1975 Oertle ..... 339/16 R
4,086,115 A * 4/1978 Sweet et al. ..... 156/178
4,121,193 A * 10/1978 Denison ..... 340/855.1
4,220,381 A * 9/1980 van der Graaf ..... 340/853.7
4,243,112 A 1/1981 Sartor ..... 175/55

(Continued)

FOREIGN PATENT DOCUMENTS

DE 1 189 934 10/1963

(Continued)

OTHER PUBLICATIONS

International Search Report, dated Mar. 12, 2003 for PCT/GB02/04646.

(Continued)

*Primary Examiner*—Ross Gushi
(74) *Attorney, Agent, or Firm*—Patterson & Sheridan, L.L.P.

(57) ABSTRACT

A generally tubular drill string has a conductive path over a plurality of drill pipe section (10). Each drill pipe section has a first end and a second end, and a wall, and the first end has a first radial sealing surfaces (11) and the second end has a corresponding second radial surfaces (59), such that when the first or second end of one drill pipe section is engaged with the second or first end respectively of another drill pipe section, at least one seal is formed. The drill pipe includes at least one conductor (21) disposed inside it, this conductor being connected to a first contact means at the first end and a corresponding contact means at the second end of each drill pipe section. Ingress protection means (240) are provided to protect the contact means from ingress from inside or outside of the drill pipe section. The ingress protection means comprises a sealed volume surrounding the contact means.

37 Claims, 16 Drawing Sheets

U.S. PATENT DOCUMENTS

| | | | | | |
|---|---|---|---|---|---|
| 4,416,494 | A | | 11/1983 | Watkins et al. | 339/15 |
| 4,445,734 | A | | 5/1984 | Cunningham | 339/16 C |
| 4,496,203 | A | | 1/1985 | Meadows | 339/16 C |
| 4,508,174 | A | | 4/1985 | Skinner et al. | 166/373 |
| 4,512,424 | A | | 4/1985 | Heemstra | 175/299 |
| 4,537,457 | A | * | 8/1985 | Davis et al. | 439/190 |
| 4,557,538 | A | * | 12/1985 | Chevalier | 439/194 |
| 4,690,212 | A | * | 9/1987 | Termohlen | 166/65.1 |
| 4,736,797 | A | | 4/1988 | Restarick, Jr. et al. | 166/301 |
| 4,770,248 | A | * | 9/1988 | Houlgrave et al. | 166/341 |
| 4,799,544 | A | * | 1/1989 | Curlett | 166/65.1 |
| 4,806,115 | A | * | 2/1989 | Chevalier et al. | 439/194 |
| 4,890,682 | A | | 1/1990 | Worrall et al. | 175/61 |
| 5,033,557 | A | | 7/1991 | Askew | 175/297 |
| 5,052,941 | A | * | 10/1991 | Hernandez-Marti et al. | 439/194 |
| 5,060,737 | A | * | 10/1991 | Mohn | 175/104 |
| 5,086,853 | A | | 2/1992 | Evans | 175/297 |
| 5,334,801 | A | | 8/1994 | Mohn | 174/47 |
| 5,389,003 | A | * | 2/1995 | Van Steenwyk et al. | 439/191 |
| 5,511,620 | A | | 4/1996 | Baugh et al. | 166/387 |
| 5,520,255 | A | | 5/1996 | Barr et al. | 175/24 |
| 5,553,679 | A | | 9/1996 | Thorp | 175/73 |
| 5,706,905 | A | | 1/1998 | Barr | 175/61 |
| 5,820,416 | A | * | 10/1998 | Carmichael | 439/668 |
| 6,029,748 | A | | 2/2000 | Forsyth et al. | 166/380 |
| 6,108,268 | A | * | 8/2000 | Moss | 367/82 |
| 6,112,818 | A | | 9/2000 | Campbell | 166/384 |
| 6,123,561 | A | | 9/2000 | Turner et al. | 439/194 |
| 6,223,826 | B1 | * | 5/2001 | Chau et al. | 166/380 |
| 6,234,719 | B1 | | 5/2001 | Roynestad | 405/232 |
| 6,254,147 | B1 | | 7/2001 | Edwards | 285/334.4 |
| 6,290,004 | B1 | | 9/2001 | Evans | 175/296 |
| 6,296,066 | B1 | | 10/2001 | Terry et al. | 175/92 |
| 6,392,317 | B1 | * | 5/2002 | Hall et al. | 307/90 |
| 6,394,837 | B1 | * | 5/2002 | Edwards et al. | 439/426 |
| 6,446,728 | B1 | * | 9/2002 | Chau et al. | 166/380 |
| 6,481,495 | B1 | | 11/2002 | Evans | 166/65.1 |
| 6,641,434 | B1 | * | 11/2003 | Boyle et al. | 439/577 |
| 6,655,460 | B1 | | 12/2003 | Bailey et al. | 166/301 |
| 6,655,464 | B1 | * | 12/2003 | Chau et al. | 166/380 |
| 6,670,880 | B1 | * | 12/2003 | Hall et al. | 336/132 |
| 6,688,396 | B1 | * | 2/2004 | Floerke et al. | 166/380 |
| 6,717,501 | B1 | * | 4/2004 | Hall et al. | 336/132 |
| 6,821,147 | B1 | * | 11/2004 | Hall et al. | 439/581 |
| 6,830,467 | B1 | * | 12/2004 | Hall et al. | 439/194 |
| 6,844,498 | B1 | * | 1/2005 | Hall et al. | 174/75 C |
| 6,845,822 | B1 | * | 1/2005 | Chau | 166/380 |
| 6,945,802 | B1 | * | 9/2005 | Hall et al. | 439/194 |
| 2003/0211768 | A1 | * | 11/2003 | Cameron et al. | 439/191 |
| 2005/0070144 | A1 | * | 3/2005 | Hall et al. | 439/191 |
| 2005/0074998 | A1 | * | 4/2005 | Hall et al. | 439/191 |
| 2005/0118848 | A1 | * | 6/2005 | Hall et al. | 439/194 |

FOREIGN PATENT DOCUMENTS

| | | |
|---|---|---|
| WO | 97/20130 | 6/1997 |

OTHER PUBLICATIONS

Annex to Form PCT/ISA/206, partial Search Report, for PCT/GB02/02797.

International Search Report, dated Nov. 7, 2002 for PCT/GB02/02933.

British Search Report, dated Oct. 24, 2001 for GB 0114872.5.

* cited by examiner

ELECTRICAL CONDUCTING SYSTEM

BACKGROUND OF THE INVENTION

The present invention relates to the transmission of power and data within a well bore, in particular, through a drill-string.

When drilling a borehole, or performing operations to maintain the borehole or operations associated with the production of oil or gas, it is often desirable to transmit power to various downhole devices, such as drill bits and traction tools. Various instruments can also be included on a drill string in order to gather data concerning the structure of the environment of the borehole, and the performance of the borehole operations and downhole devices. It is advantageous for this data to be transmitted back to the surface along an electrical conductor.

In one cabling system, each drill pipe section includes a contact ring at each end of the section. A passageway between each ring accommodates an armoured conductor which connects the two contact rings. When the drill pipe sections are made up in a drill string, the contact rings of adjacent drill pipe sections abut and a circuit is formed over the drill string.

Such a system is vulnerable to poor connections between the abutting contact rings. Ideally contact rings should be clean, and a specialised non-conductive "pipe dope" or joining compound (which is more expensive than standard pipe dope) must be used in order not to short the connection. Another disadvantage of this system is that the connection between the amoured cable and the contact rings are subjected to borehole pressure and are susceptible to fail.

Alternative systems (such as disclosed in U.S. Pat. No. 4,788,544) use inductive pick-ups between the mating surfaces of adjacent drill pipe sections. Such linkage, whilst reducing the chance of bad connections, is not suitable for all types of telemetry and power transfer.

SUMMARY OF THE INVENTION

The object of the present invention is to provide an apparatus and method for reliably disposing cabling in a drill string.

According to the present invention there is provided a generally tubular drill string having a conductive path over a plurality of drill pipe sections, each drill pipe section having a first end and a second end, and having a wall, and the first end having a first radial sealing surfaces and the second end having a corresponding second radial sealing surfaces, such that when the first or second end of one drill pipe section is engaged with the second or first end respectively of another drill pipe section, at least one seal is formed, wherein the drill pipe includes at least one conductor disposed inside it, this conductor being connected to a first contact means at the first end and a corresponding contact means at the second end of each drill pipe section.

Preferably, ingress protection means are provided to protect the contact means from ingress from inside or outside of the drill pipe section.

The ingress protection means may comprise a sealed volume surrounding the contact means. Alternatively or additionally, the ingress protection means may be a pressure release duct from one side of the contact means to the other. Alternatively or additionally, the ingress protection means may comprise an inner sleeve or seal.

Preferably, the first contact means and the second contact means are provided by corresponding conductive rings coaxial with the drill pipe.

Preferably, the wall of the drill pipe includes within it at least one bore wherein a conductor is disposed.

Preferably, the conductive connection consists of the first conductive rings in contact with an outer ring conductor, or resilient member, wherein the resilient member comprises an annular spring.

According to another aspect of the present invention, there is provided a generally tubular drill pipe having a conductive path over a plurality of drill pipe sections, each drill pipe section having a first end and a second end, and having a wall, and the first end having a first radial sealing surfaces and the second end having a corresponding second radial sealing surfaces, such that when the first or second end of one drill pipe section is engaged with the second or first end respectively of another drill pipe section, at least one seal is formed, wherein a conductor is connected to a first contact means at one end and a plug at the other end, and, wherein ingress protection means are provided to protect the contact means from ingress from inside or outside of the drill pipe section.

According to another aspect of the present invention there is provided a drill pipe section as herein defined.

According to another aspect of the present invention there is provided a generally tubular drill pipe having a conductive path over a plurality of drill pipe sections, each drill pipe section having a first end and a second end, and having a wall, and the first end having a first radial sealing surfaces and the second end having a corresponding second radial sealing surfaces, such that when the first or second end of one drill pipe section is engaged with the second or first end respectively of another drill pipe section, at least one seal is formed, wherein the wall includes within it at least one bore, the bore having a conductor disposed inside it, this conductor being connected to a first contact means at the first end and disposed to travel through a box sealing carrier at the second end of each drill pipe section, wherein ingress protection means are provided to protect the contact means from ingress from inside or outside of the drill pipe section.

According to another aspect of the present invention there is provided a conductive connection for use between two tubulars comprising:

a terminating portion of a conductor in a female end of a first tubular;

a mating terminating portion of a conductor around a male end of a second tubular; and, a sealed volume formed when the first and second tubulars are threaded together, the sealed volume housing the conductive connection.

According to another aspect of the present invention there is provided a first drill pipe section for use in a drill pipe string. The drill pipe section comprising:

a first end and a second end;

a conductive path connecting the first and second ends;

the conductive path being connected to a first contact member and a second contact member at the second end;

a first seal member at the first end and a second seal member at the second end;

the first and second seal members for sealing engagement with a first or second end respectively of a second drill pipe section; and, the sealing engagement forming a sealed volume and the contact members being within the sealed volume.

A drill pipe section is generally tubular and therefore has a central throughbore often used for the passage of well fluids. The present invention also includes bores formed or situated in the walls of drill pipe sections; and reference to bores refers to these wall bores, whereas the main bore of the drill pipe is identified as the central throughbore.

BRIEF DESCRIPTION OF THE FIGURES

A telemetering system will now be described, by way of example, with reference to the drawings, of which.

DETAILED DESCRIPTION OF PREFERRED EMBODIMENTS

Figure 1:
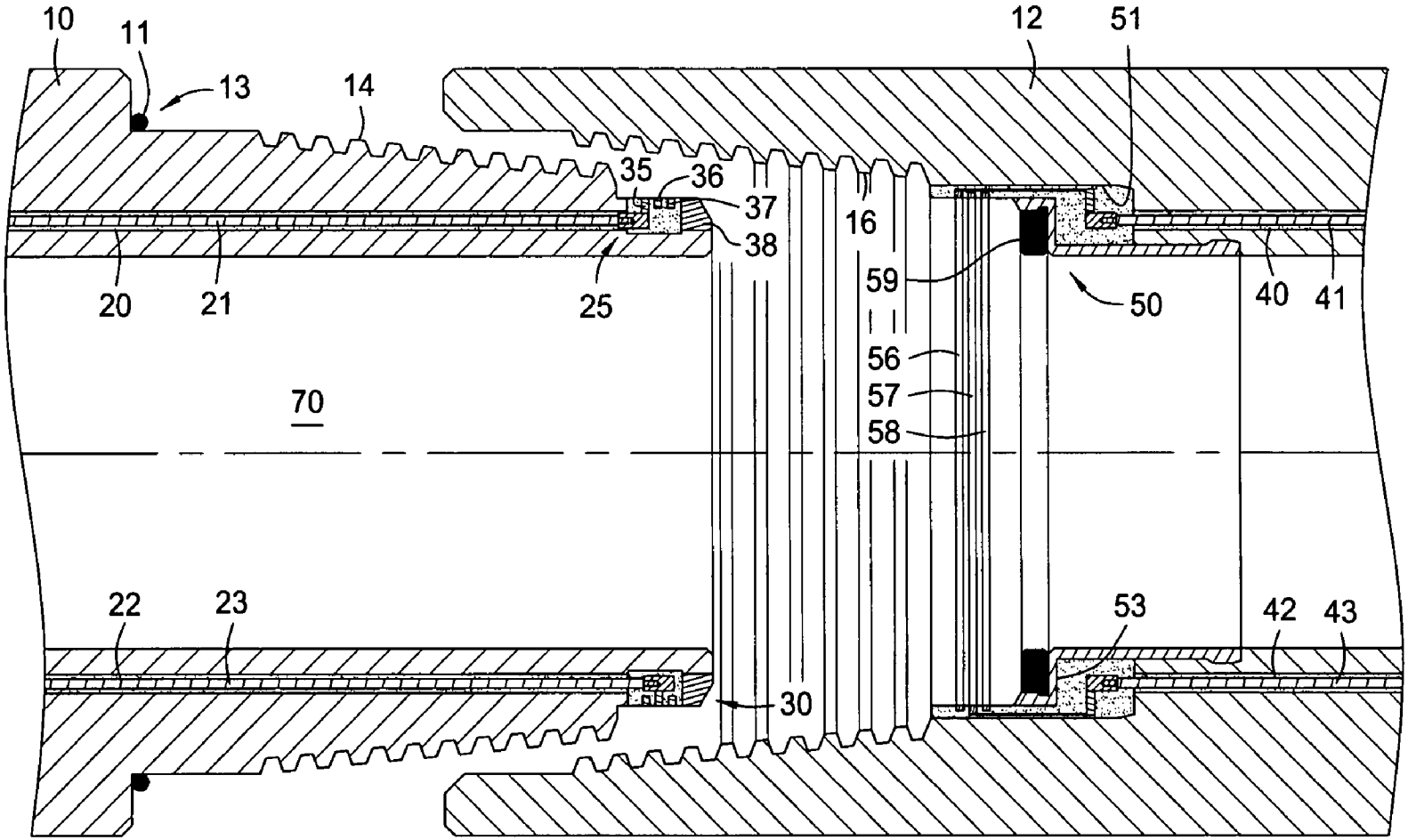
FIG. 1 is a longitudinal sectional view of two facing ends of adjacent drill pipe sections in a disengaged state.

Generally, in the drawings, parts made from an insulating material (except for non-metal seals, which are black) are hatched with a dot pattern; parts, i.e. conductors, drill pipe, etc., usually made from metal (except for fasteners) are conventionally hatched (where clarity and size allow); and fasteners, i.e. bolts, screws, sockets, plugs, etc., are not hatched. FIG. 1 shows opposing ends of two adjacent drill pipe sections 10, 12. One drill pipe 12 has a female receiving thread 16, which is engaged by rotation of the corresponding male thread 14 of the other drill pipe 10. Each drill pipe has three bores drilled longitudinally inside the drill pipe wall, equally spaced around the radius of the drillpipe section (when spaced at 120° around the radius of the drill pipe, a longitudinal section taken centrally through the drill pipe section would not show two bores; two bores 20, 22 are here shown to better illustrate the nature of the connections).

The bore 20 opens at the male end at a region 25 forward of (considering forward to be towards the right in the figure) and proximal to the thread 14. A conductor 21 is introduced into this bore 20. Space or other considerations within the drill pipe, and its wall cavity, wall may require the conductor 21 to have an aspect ration not equal to one. As herein defined, when viewing the cross-sectional area of a conductor 21, aspect ratio is the measurement of the overall length of the conductor divided by the measurement of the overall width of the conductor. As an example, a conductor 21 with a circular cross-sectional area would have equal length and width measurements, and thus would have an aspect ration equal to one. A conductor 21 that is rectangular in cross-sectional area would have a length measurement greater than a width measurement, consequently this conductor would have an aspect ratio greater than one.

Where the bore opens at the male end of the drill pipe section 10, a male connector 30 is attached, the conductor 21 terminating in this male connector. If necessary, a recess is provided to accept the male connector 30. The male connector is annular, and includes three annular conductive rings 35, 36, 37 having surfaces exposed on the outer circumference of the male connector. Each of the three conductive rings are connected respectively to one of the three conductors. A metal sealing ring 38 is also included in the male connector.

The drill pipe 12 also features three longitudinal bores (40, 42 being visible here) which emerge at the female end of the drill pipe forward of (again considering forward to be towards the right in the figure) and proximal to the thread 16. As for the bores 20, 22 of drill pipe 10, the bores 40, 42 include conductors 41, 43. Where the bores open at the female end of the drill pipe section 12, a female connector 50 is attached, the conductor terminating in this female connector. If necessary, a recess 51 is provided to accept the female connector 50. The female connector is annular, and includes three annular conductive rings 56, 57, 58 having surfaces exposed on its inner circumference. Each of the three conductive rings are connected respectively to one of the three conductors. The female connector includes a radial shoulder 53, this shoulder having a metal sealing surface 54. Incorporated in the radial shoulder is an annular seal 59, such as an elastomeric seal.

Figure 2:
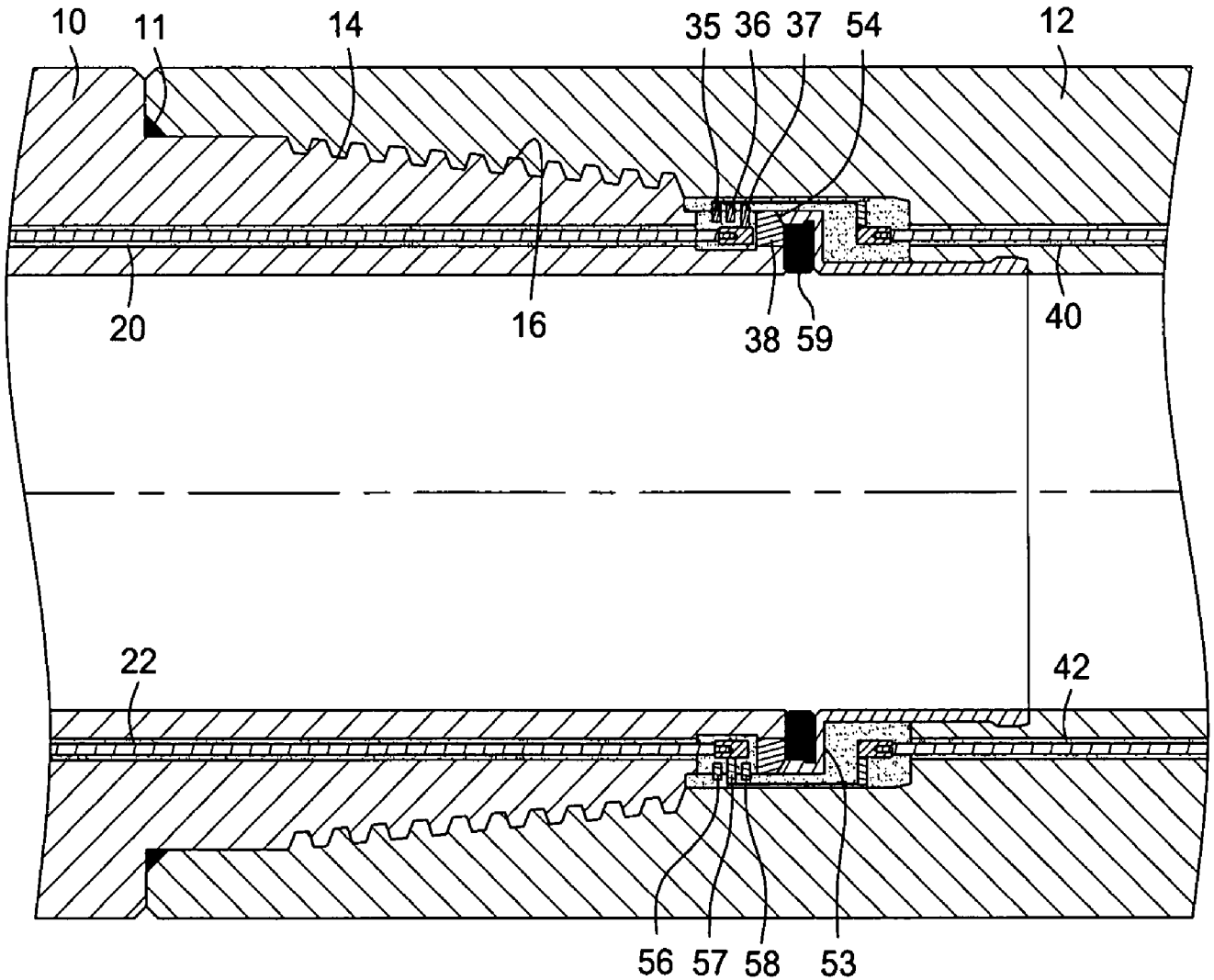
FIG. 2 is a longitudinal sectional view of two facing ends of adjacent drill pipe sections when engaged.

Referring to FIG. 2, when the male thread 14 of drill pipe 10 is introduced into the female end of drill pipe 12, the metal sealing ring 38 of the male connector compresses the annular seal 59 of the female connector until the metal sealing ring 38 abuts the female connector's metal sealing surface 54, sealing the conductive rings from inner wellbore fluid. Preferably, the annular seal is elastomeric in nature. The components of the female connector 50 lie substantially flush with the inner surface of the drill pipe section's central throughbore 70.

The three conductive rings 35, 36, 37 of the male connector now lie in conjunction with the three conductive rings 56, 57, 58 of the female connector. These connections are sealed on the one hand by the metal to metal seal between the male connector's sealing ring 38 and female connector metal sealing surface 54, augmented by the annular seal 59 which is energised by the metal sealing ring 38, and on the other hand by the mating threads 14, 16 of the male and female ends of the adjacent drill pipe sections. An o-ring seal 11 is included in the shoulder 13 of the male end of the drill pipe section 10. Thus the contacting conductive rings are not exposed to the corrosive components usually present in well fluid.

Each drill pipe section includes both a male end and a female end having respectively male connector and female connector as described, the conductors disposed in the bores running the entire length of each drill pipe section. As these drill pipe sections are made up into a drill string, three conductive paths along the drill string are formed.

The drill pipe section's longitudinal bores 20, 22, 40, 42 ideally run parallel to the drill pipe sections' axes. When two drill pipe sections are undone and are to be remade, the mating threads 14, 16 may not engage to the same position as when they were initially made up. Further, before two separated drill pipe sections are remade, the drill pipe sections' ends may be shortened and/or rethreaded. The male and female connectors 30, 50 will therefore have to be repositioned, and accommodating recesses/profiles in the drill pipe sections have to be remilled. These operations are simplified by the longitudinal bores 20, 22, 40, 42 being essentially parallel to the drill pipe's axis, so that the radial displacement of the bores remains constant as axial displacement is varied.

Figure 3:
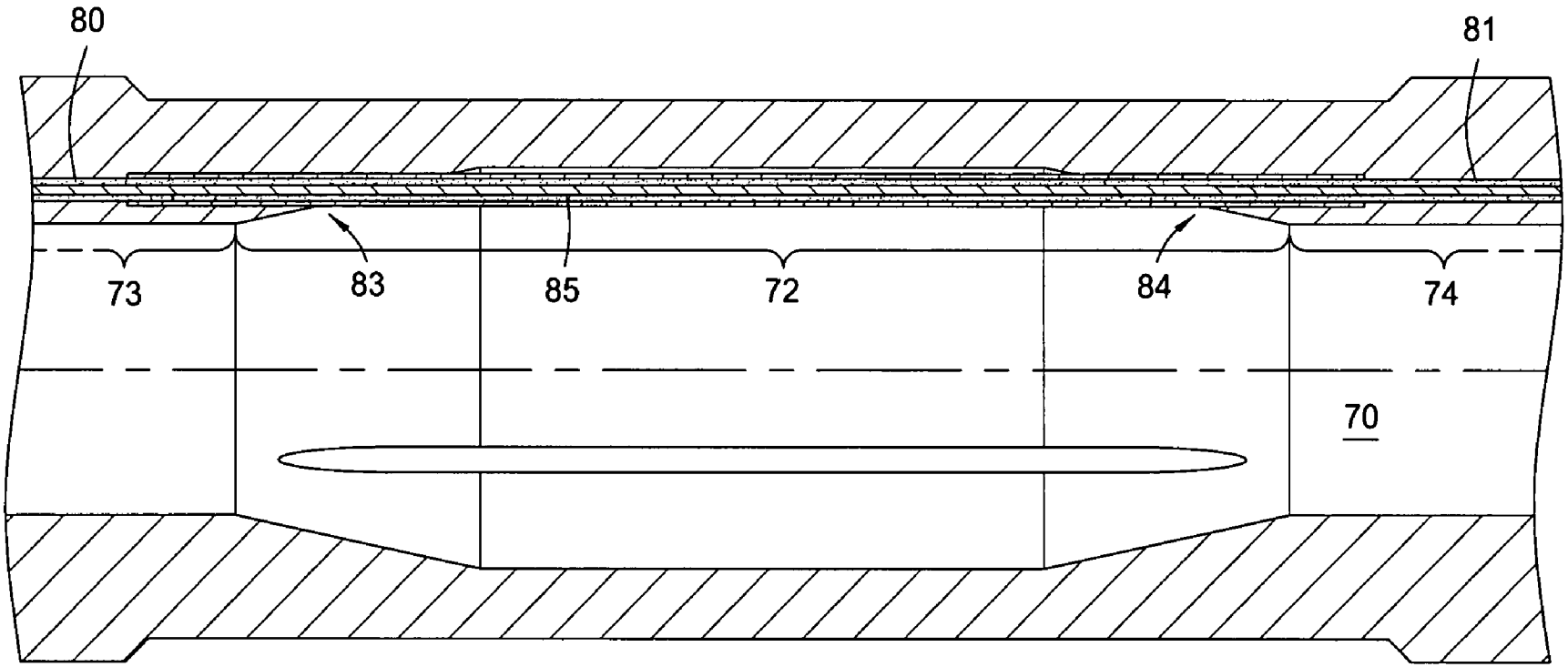
FIG. 3 is a longitudinal sectional view of the middle portion of a drill pipe section.

Referring to FIG. 3, the central throughbore of a drill pipe section typically includes a widened middle region 72 between to relatively narrow end regions 73, 74, the end regions having a greater thickness of material to give additional strength in the area where the drill pipes are joined. It may not therefore be possible to produce a straight longitudinal bore along the entire length of the drill pipe section without impinging upon the drill pipe section's threads. When this is the case, two aligned bores 80, 81 are drilled into the drill pipe section, and a tube of resilient material 85 is attached in a sealed manner between the facing mouths 83, 84 of the two bores to form an enclosed bore running the length of the drill pipe section.

Figure 4:
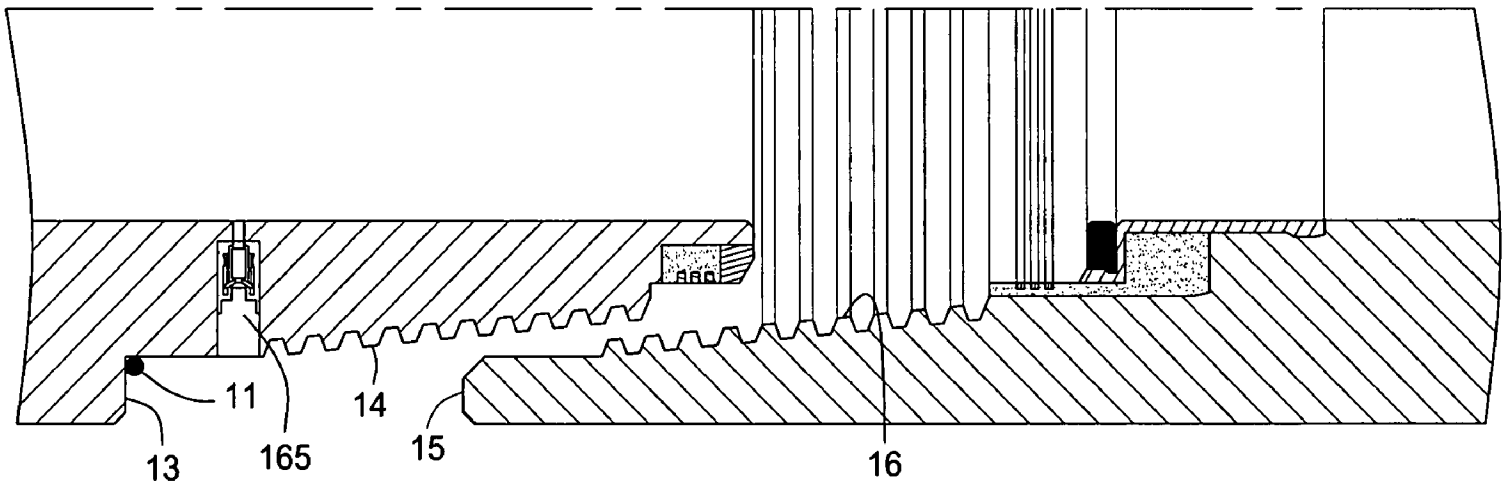
FIG. 4 is a partial longitudinal sectional view of a further embodiment of two facing ends of adjacent drill pipe sections in a disengaged state.

The drill pipe section's bores are filled with oil. As the environmental pressure in the well bore hole is increased, this oil may be pressurised in order to equalise the pressure between the connection with the external pressure and so reduce the stress exerted on the seals. The resilient material 85 connected between the facing mouths 83, 84 is compressed in response to increasing external pressure, reducing the volume of the bore 80, 81, increasing the bore's pressure and thus reducing the pressure difference. The equalisation of the bore's pressure could be alternatively or additionally be achieved using, for example, a pressure gauge and actuator mechanism Referring to FIGS. 4 and 5, the male end of the drill pipe section 10 includes a pressure release valve 165 forward of the shoulder 13. When the drill pipe sections 10, 12 are made up, lubrication grease on the threads is pressurised as it becomes trapped in a decreasing volume between the metal to metal and elastomeric seals 38, 53, 59 of the male and female connectors 30, 50 on the one hand, and the metal to metal seal between the shoulder 13 of the male end of drill pipe section 10 and the end 15 of the female end of drill pipe section 12, and the elastomeric seal 11 on the other hand. The pressure release valve allows excess lubricating grease to escape when a certain pressure is reached. This pressure is set such that it does not stress the seals when the environmental pressure is low, but is sufficient to afford protection to the seals when the environmental pressure is high. Rather than a pressure release valve, a weep hole may instead be provided. It will be realised that position of the pressure release valve may be varied, for example it could be included at the female end of drill pipe section 12 backward of the female thread, venting excess lubricating grease outside the drill string.

Figure 6:
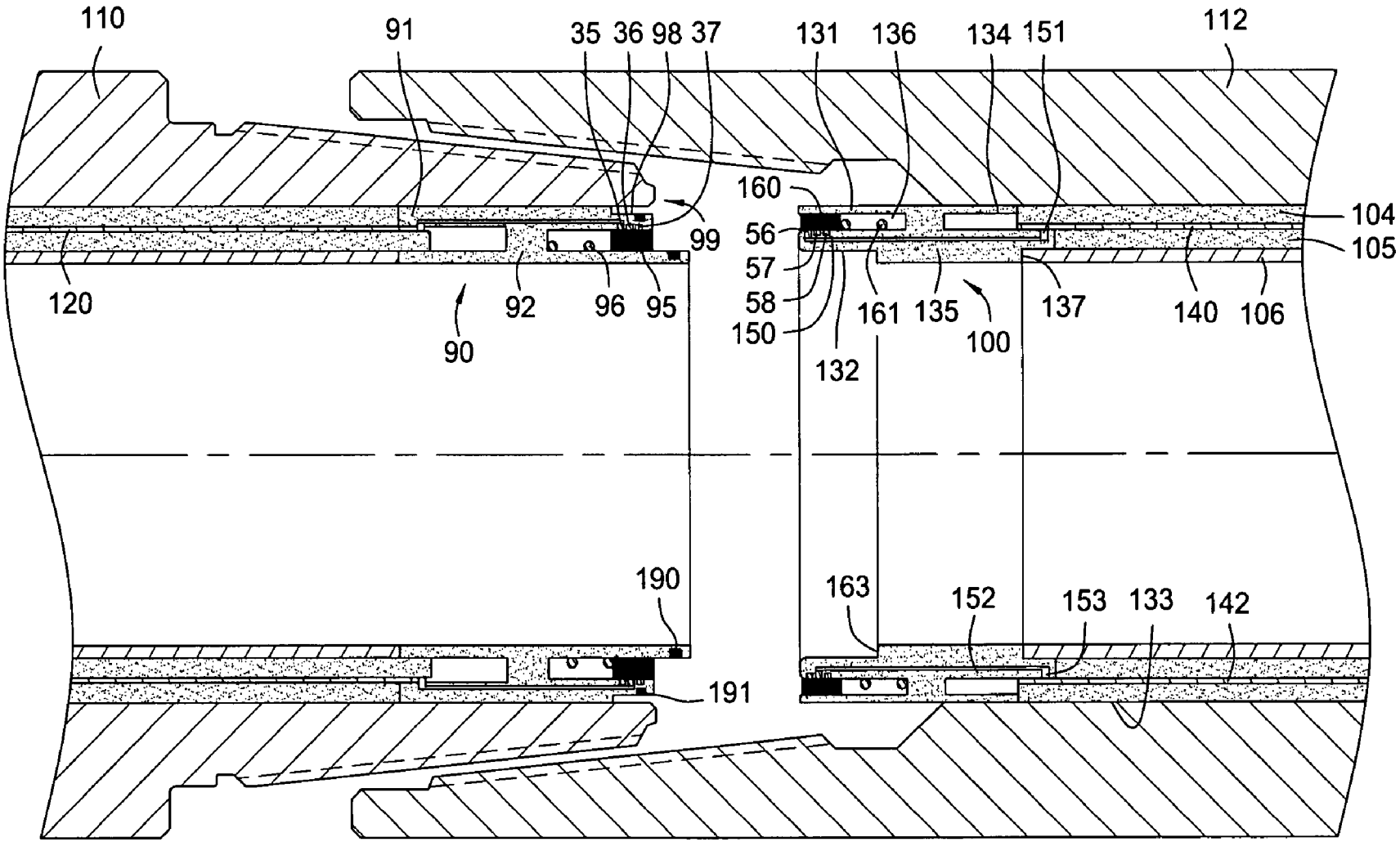
FIG. 6 is a longitudinal sectional view of another embodiment of two facing ends of adjacent drill pipe sections in a disengaged state.

Referring to FIG. 6, in an alternative embodiment the male connector 91 installed in a drill pipe section 110 includes two forward facing collars 91, 92.

An annular cavity if formed between the two forward facing collars 91, 92 of the male connector 30. In this cavity is an annular seal 95, biased by a spring 96 to be held covering the surface of the conductive rings 35, 36, 37. The inner collar 92 extends further from the male connector than the outer collar 91. The outer collar includes a ledge 98 which, in conjunction with the drill pipe, forms a circular groove 99.

The adjacent drill pipe section 112 is similar to the drill pipe section 110 just described, and includes three longitudinal bores 140, 142 (only two of which are visible here) located near the inner surface of the drill pipe section. In this embodiment, the bores, rather than being integrally formed in the wall of the drill pipe section, are provided in a lining, or inner sleeve. The conductors are here formed between two coaxial tubes, the conductors being semi-cylindrical elements of similar curvature to the tubes, such that the three conductors can be placed axially upon the inner tube, with spacer means between each conductor, each conductor subtending some angle less than 120° of the tube's circumference. The outer tube is then affixed to the inner tube, and the assemble is then secured in the drill pipe section.

Figure 6A:
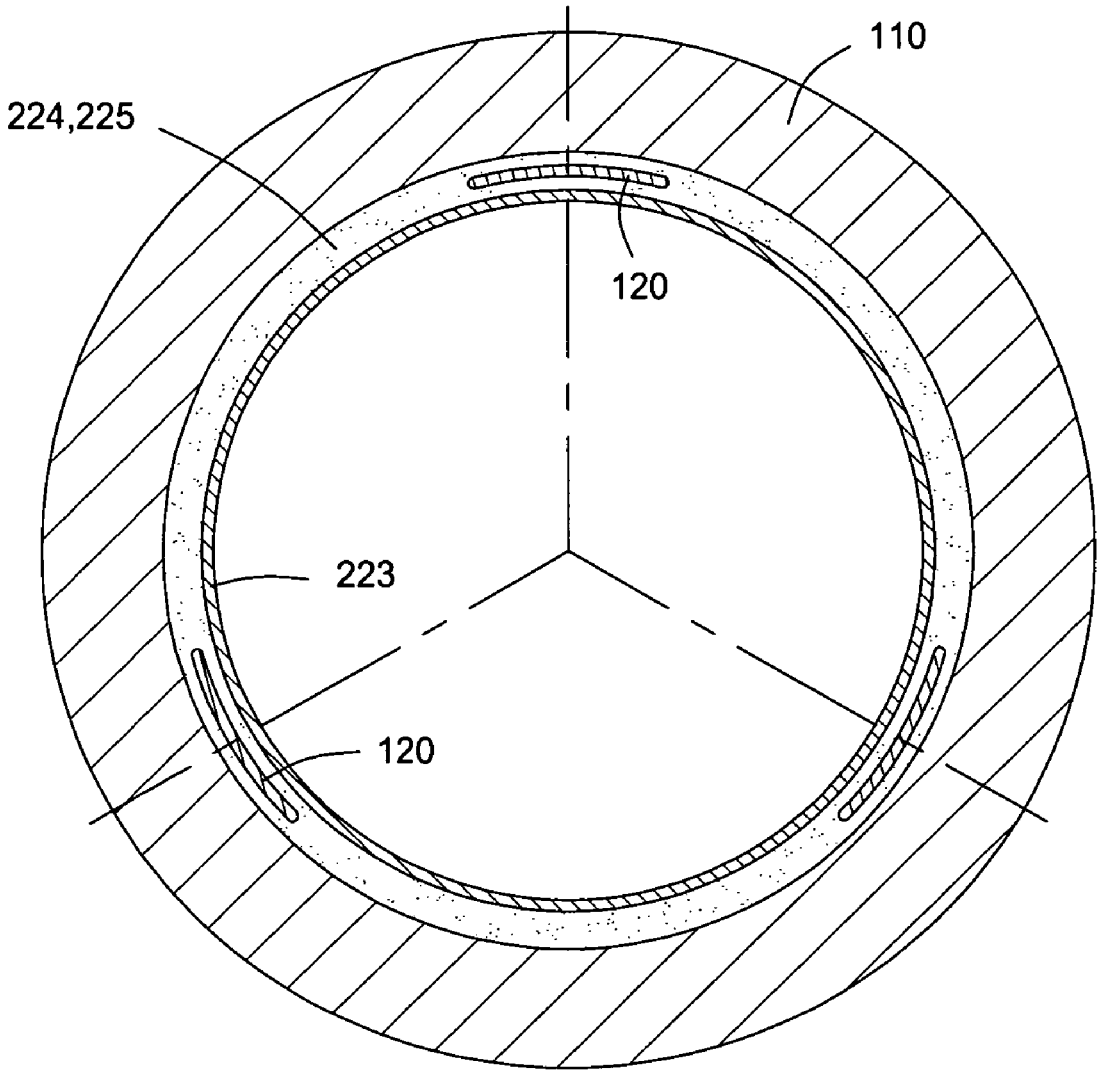
FIG. 6A is a sectional view of a conductor assembly for use with the embodiment of FIG. 6.
Figure 7:
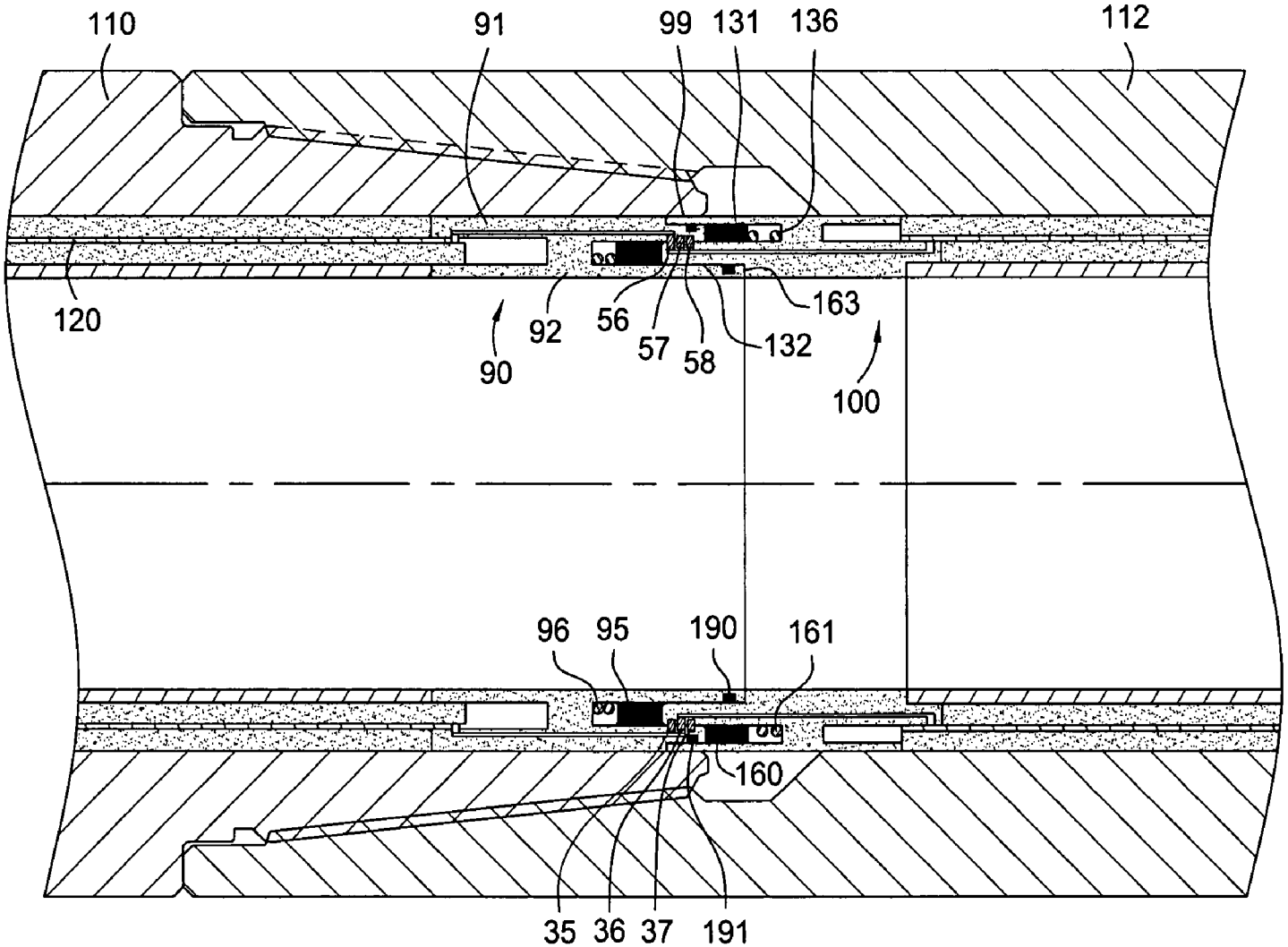
FIG. 7 is a longitudinal sectional view of this embodiment when engaged.

Referring FIG. 6A, the conductor assembly may be formed in part by an extrusion process, the inner tube being formed using a gas impermeable metal tube, or sleeve, 223 the outer surface of which is coated by extrudate 224, the conductors 120 being affixed to the coated inner tube, and the inner tube and conductors 120 being coated again in another extrusion stage 225 to cover and hold the conductors 120 in a spaced relationship. This assembly may now be introduced to the drill pipe section 110. In general, the inner sleeve shields the conductors from wellbore fluid.

The three semi-cylindrical conductors 120 are each respectively connected to one of the three conductive rings 56, 57, 58 present in the female connector described below.

A portion of the inner surface of the drill pipe at the female end is removed to create a profile 103. If a lining or sleeve is used, the lining may be made up of layers 104, 105, 106 to form the profile; it will be noted that the profile of the male end of the inner surface is the complement of the profile of the female end of the inner surface, so the profile may be achieved by using similar layers of material, with the different layers being axially displaced to create the profile. This profile 103 engages with a female end connector 100. When one side of the drill string is considered in section as shown here, a recess is milled into the drill pipe. The female end connector includes, considering a half section portion, two forward facing collars 134, 135, one of which, the outer collar 134, abuts an inner portion 133 of the drillpipe section 112, and one of which, the inner collar 135, both engages with the recess in the profile 103 and features a shoulder 137 abutting the inner portion of the drill pipe section. The female connector includes three bores 150, 152 similar to those 140, 142 in the drill pipe section 112, these bores being less radially displaced. Conductors run through the bores of the female connector, each conductor being connected via a contact element 151, 153 to the corresponding conductor of drill pipe section.

The female connector also includes two backward facing collars 131, 132. Three axially spaced conductive rings 56, 57, 58 are situated on the outer surface of the cylinder formed by the inner collar 132. The three conductors of the female connector are each respectively connected to one of the three rings.

An annular cavity 136 is formed between the two backward facing collars 131, 132 of the female connector. In this cavity is an annular seal 160, biased by a spring 161 to be held covering the surface of the conductive rings. The inner collar 132 includes a shoulder 163 on its inner diameter.

Figure 5:
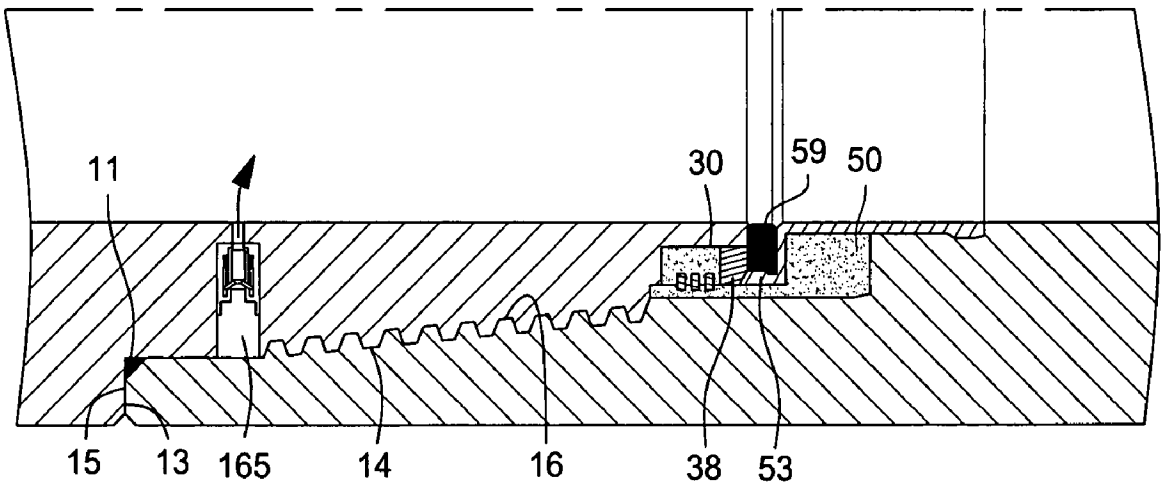
FIG. 5 is a partial longitudinal sectional view of this embodiment when engaged.

Referring to FIG. 5, when the male end of the drill pipe section 110 is fully engaged with the female end of the adjacent drill pipe section 120, the male connector 90 and female connector 100 also engage. Specifically, the forward facing outer collar 91 of the male connector 90 engages in the cavity 136 between the backward facing inner collar 132 and outer collar 131 of the female connector 100, and the outer collar 131 of the female connector engages in the cavity between the forward facing inner collar 92 and outer collar 91 of the male connector. The outer collar 131 of the female connector is accommodated in the circular groove 99 formed between the outer collar 91 of the male connector and the drill pipe 110. The inner collar 92 of the male connector abuts the shoulder 163 of the outer inner collar 132 of the female connector. Thus, the male 90 and female 100 connectors engage to produce an inner surface flush with each other and the drill pipe surface of the central throughbore sections in they are installed.

As the outer forward facing collar 91 of the male connector enters the cavity 136 of the female connector, the annular seal 160 and its spring 161 are displaced deeper into the cavity. As it is displaced, the seal 160 wipes the surface of the conductive rings 56, 57, 58, ensuring that a good contact will be formed. Simultaneously, the outer collar 131 of the female connector displaces the male connector's annular seal 95, wiping the male connector's conductive rings 35, 36, 37. When the male and female connector's are fully engaged, the three conductive rings 35, 36, 37 of the male connector and the three conductive rings 56, 57, 58 of the female connector slide into conjunction so as to form three conductive paths from the drill pipe 110 to the adjacent drill pipe 112.

The outer surface of the male connector's inner collar 92 includes an o-ring seal 190, which seals against the female connector's inner collar 131. Similarly, the outer surface of the male connector's outer collar 92 includes an o-ring seal 191, which seals against the female connector's outer collar 131.

Each drill pipe section thus features a male connector and female connector as described, so that a three conductive circuits down the length of the drill pipe are produced. As in the previous example, the bores are oil filled in order that they may be balanced with the external pressure.

Figure 8:
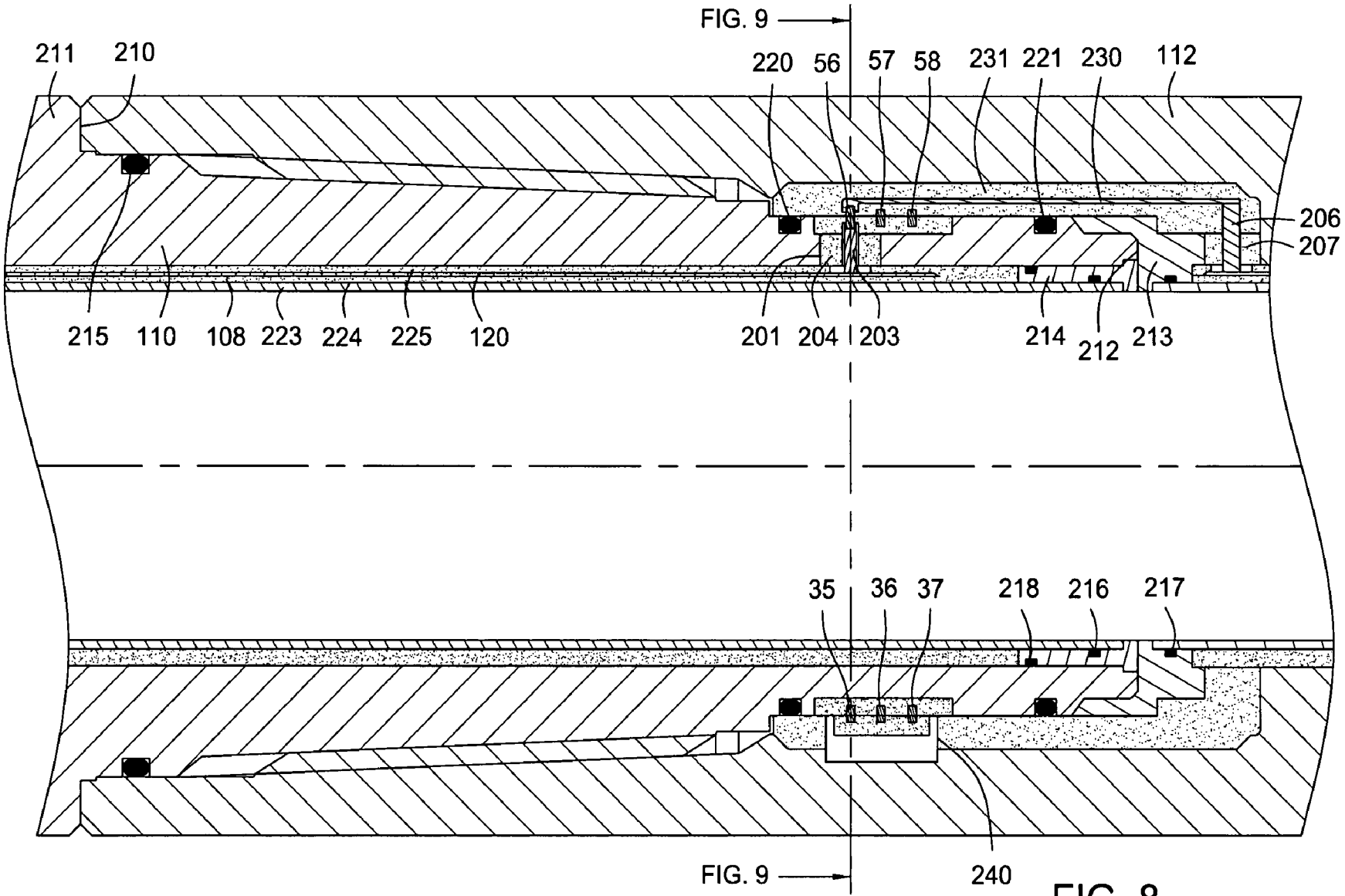
FIG. 8 is a longitudinal sectional view of a further embodiment.
Figure 9:
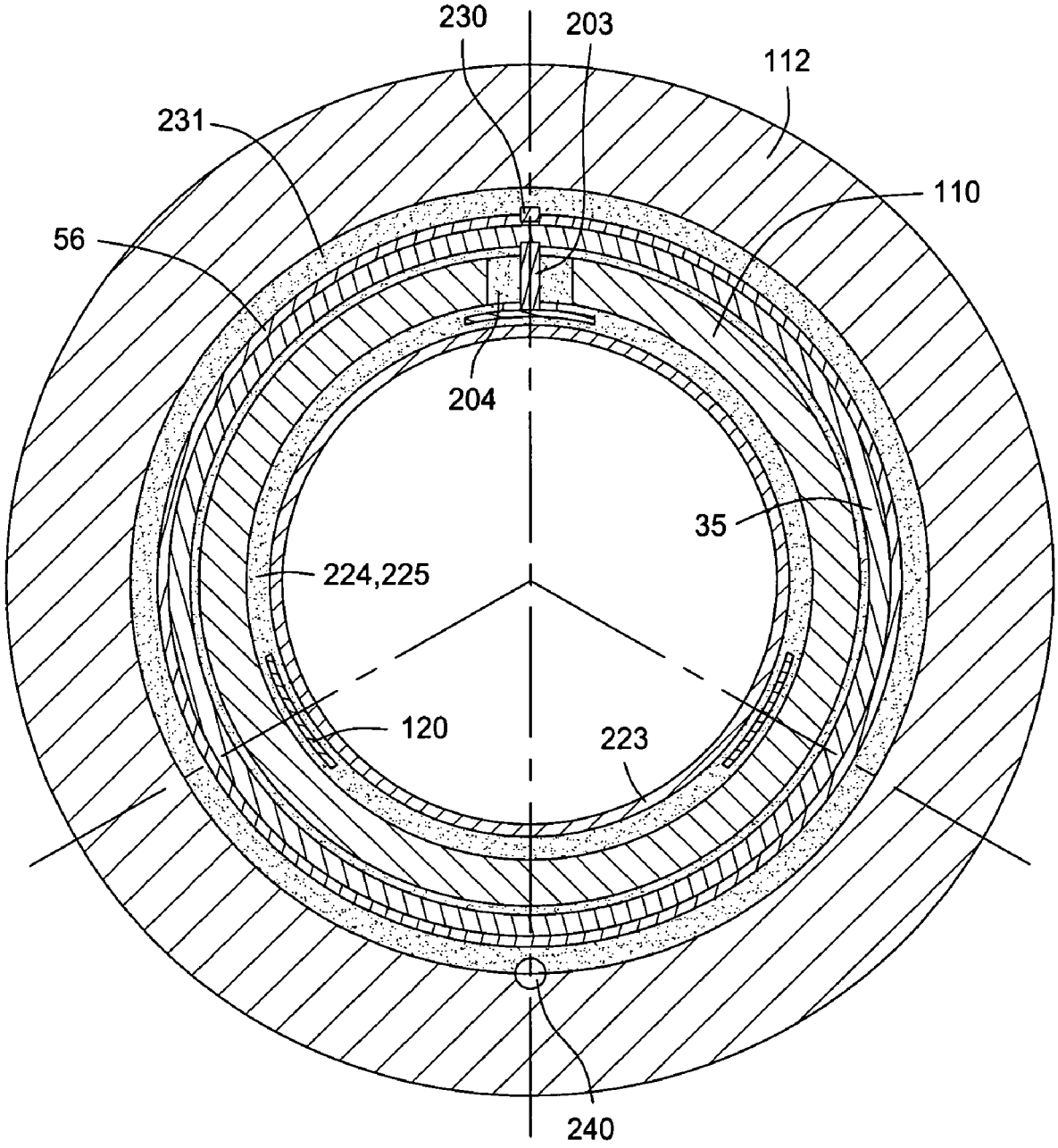
FIG. 9 is a cross sectional view through XX of this embodiment.

Referring to FIG. 8 specifically, and generally to FIGS. 8–15, three conductors 120 (here of the semi-cylindrical type as previous described) are longitudinally disposed in a laminate tubular member 108. As previously described, the tubular member may be formed partly by extrusion, for example using a steel tube 223 having an insulating layer 224, the conductors 120 then being set with another insulating layer 225. The tubular member is then inserted in the drill pipe section 110. The tubular member may be formed to follow the inner surface of the drill pipe section, for example being swaged to follow the widened portion commonly present in the mid-section of drill pipe sections. At a region forward of the male thread of the drill pipe sections, three radial apertures 201 (only one of which is visible) are bored through the drill pipe section, equally spaced around the circumference of the drill pipe section and each one somewhat displaced axially, corresponding to the axial displacement of the conductive rings 35, 36, 37. A radial conductor 203 and surrounding insulator 204 is set in each aperture, each radial conductor 204 being in contact with one of the axially disposed conductors 35, 36, 37. The conductor 203 protrudes from the insulator 204, so that when the conductive rings are fitted, the relevant conductive ring 181 is pressed against the protruding conductor 203 to ensure a good conductive path. This radial conductor is also shown in FIG. 9.

The female end of the drill pipe section 112 includes similar radial conductors 206 (only on of which is visible), again set in a radial bore using an insulator 207. The radial conductors 206 are connected to a conducting elements 230 set in an insulating collar 231. Each conducting element 230 is attached to a conductive ring 56, 57, 58. When the male end of the drill pipe section 110 is inserted into the female end of drill pipe section 112, these conductive rings 56, 57, 58 align with and form a conductive contact with the conductive rings 35, 36, 37.

This embodiment includes radial metal to metal seals where the hindmost (hindmost being to the left in the figure) part of female thread 210 abuts the shoulder 211 behind the male thread, and the foremost part of the male thread 212 abuts a shoulder insert 213 in front of the female thread. In addition, an O-ring 215 is provided between the male and female threads, and further O-rings 216, 217, 218 are provided to seal a inserted tube securing element 214 and the shoulder insert carrying the conductors. Wiper ring seals 220, 221 either side of the conductive rings 181, 182, 183 and conductive rings are also provided set in the male part of the drill pipe section. As the male part of one drill pipe section is inserted into the female part of another drill pipe section, these wiper rings 220, 221 wipe over the conductive rings 35, 36, 37, 56, 57, 58, cleaning any debris of to ensure a good connection can be made, as well as providing addition seals.

As previously mentioned, the volume between the inner and outer sets of seals are preferably filled with non-conductive lubrication grease or 'pipe dope'. This grease is substantially incompressible, and is also pressurised as the male and female parts are screwed together (and, as previously mentioned, a pressure release valve may be included). If a seal does fail, the penetration of the well bore fluids will be reduced or eliminated by the presence of the grease in the previously sealed volume, since the fluids will only continue to penetrate the volume until while the pressure of the grease is less than that of the fluids; when the pressures are equalised the fluid penetration will cease, and, since the grease is substantially incompressible, the conductive contacts will not have been exposed but will still be enveloped by the grease. To the extent that some of the sealed volume cannot be filled with grease, or to the extent that the grease is compressible, a grease reservoir may be included one or both sides of the electrical contacts to ensure that grease remains around the contacts even after the grease has been displaced or compressed. Adjoining drill pipe sections could be provided with just a single seal, so that the electrical contact portions (the conductive rings, radial conductors etc.) are open to well bore fluids, but that the volume between the seal and the electrical contacts, and extending somewhat beyond these electrical contacts, is filled with substantially incompressible grease.

Figure 10:
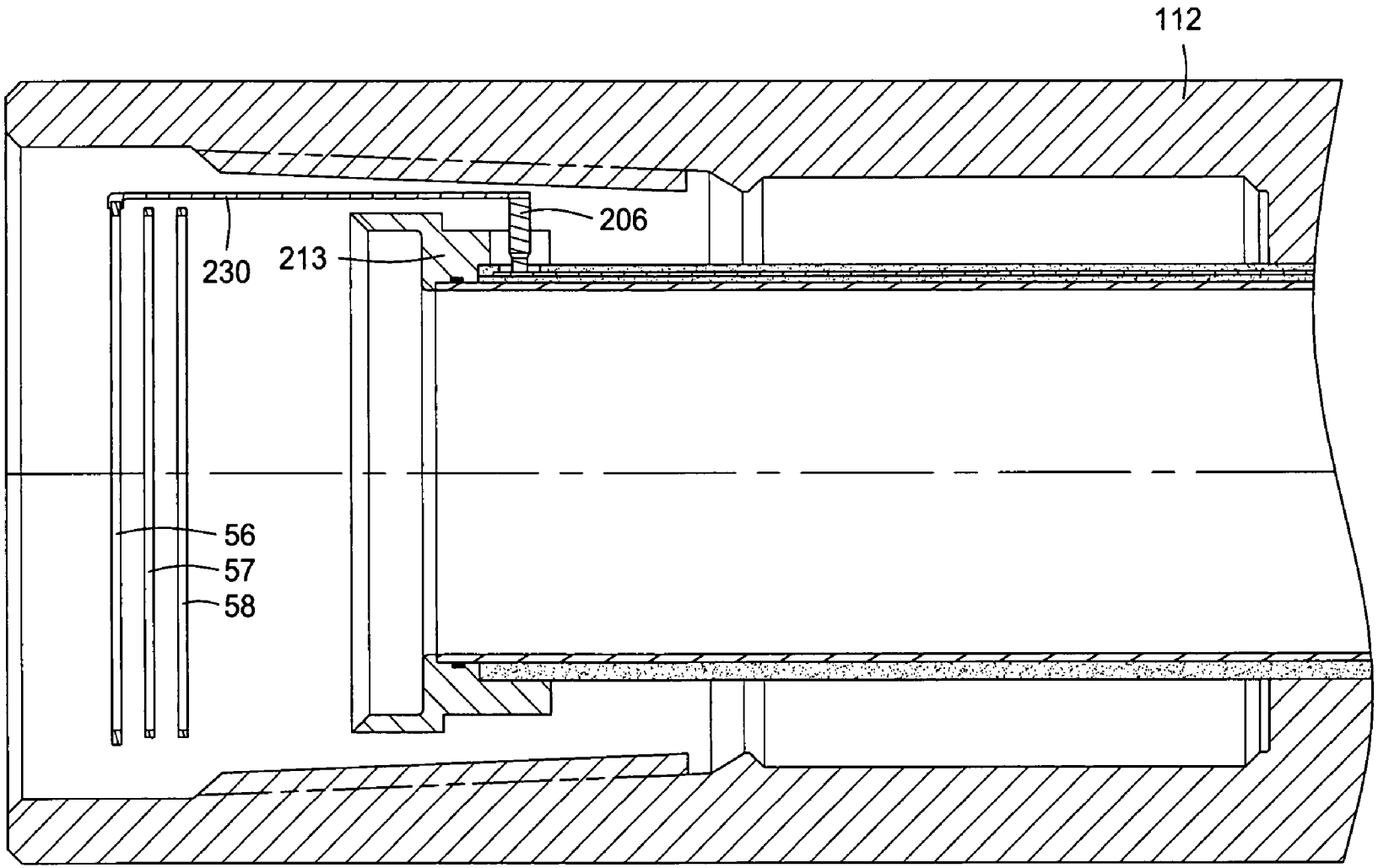
FIG. 10 is a longitudinal sectional view of part of the embodiment during manufacture.

Drill pipe sections may also include a by-pass duct 240, as shown in FIG. 8, which extends from one side of the contacts to the other so that any pressure difference arising between the inside of the drill pipe and the voids in the thread, or due to any leakage of one of the seals, or if only one seal is provided will result in fluids by-passing the contact zone equalising the pressure either side of the electrical contacts without displacing the grease covering the contacts The radial conductors 206, conductive elements 230 and conductive rings 36, 37, 38 may be set in the insulator by positioning the conducting elements, and the shoulder insert, with the extruded tubular member in situ, as shown in FIG. 10, using a jig arrangement (not shown) to ensure the correctly spaced arrangement, and a mould (also not shown) to form the insulating portions using a pourable settable insulator. The arrangement of conductors at the male end may be similarly achieved.

Figure 11:
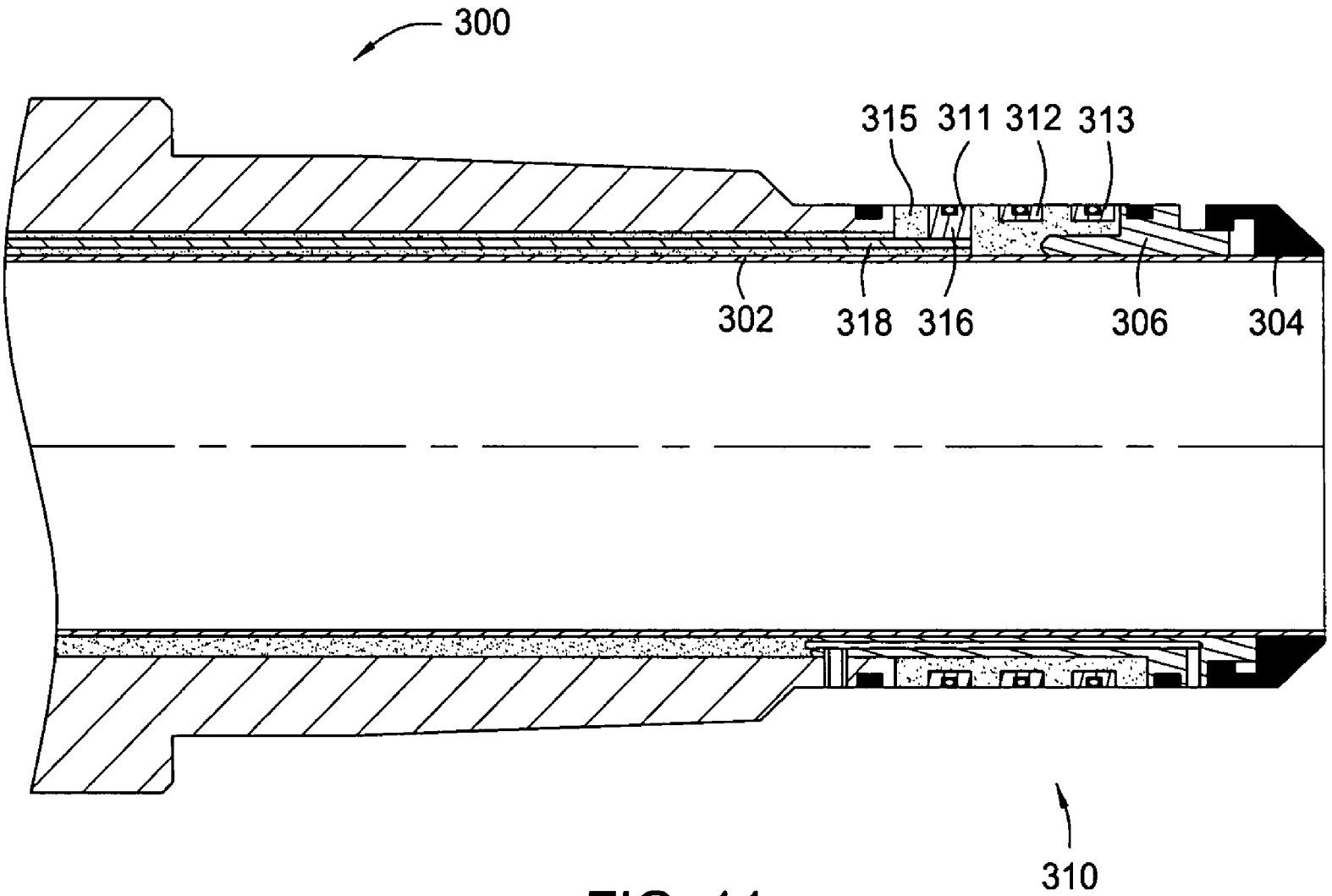
FIG. 11 is a longitudinal sectional view of the male end of an another embodiment.
Figure 12:
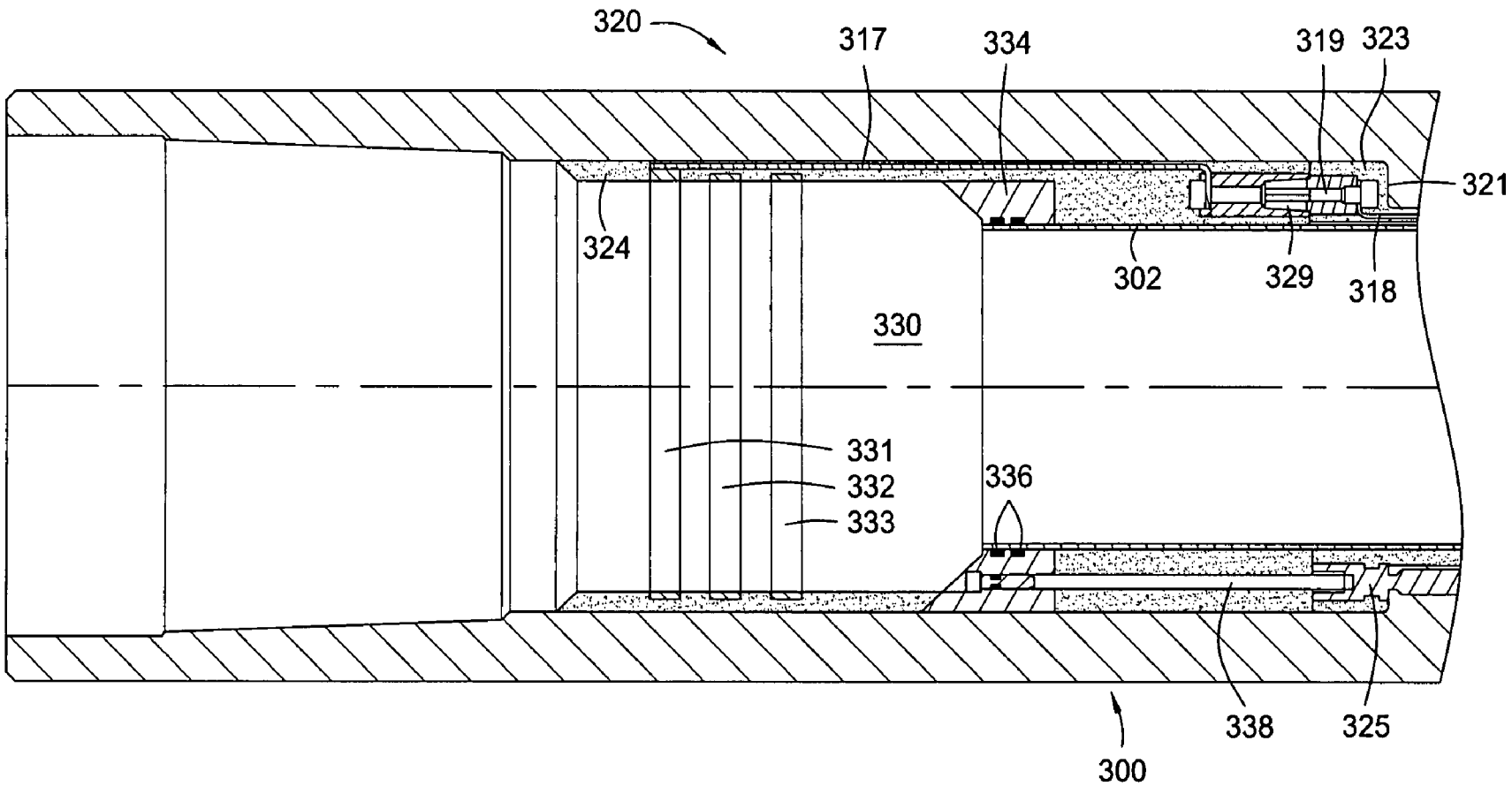
FIG. 12 is a longitudinal sectional view of the female end of this embodiment showing a module connection.

Referring to FIG. 11, in a modified embodiment, an inserted liner tube 302 extends through the drill pipe section 300. At the male thread end 310, an elastomeric nose seal 304 is located around the outer surface of the liner tube. Situated behind the nose seal (that is, to the left in the drawing) around the liner tube is a bypass collar 306. The bypass collar may be attached to the liner by laser weld. The nose seal 304 engages with the bypass collar 306. Around the bypass collar 306 are three conductive rings 311, 312, 313, axially spaced and set in insulating material 315, preferably an elastomer or ceramic. Each ring includes a radially inwardly extending portion 316 (only one here being visible). As in embodiments previously described, three conductors 318 extend along an annulus in the drill pipe between the inner surface of the drill pipe section and the inner liner tube, each conductor occupying some part of a 120° portion of the drill string's circumference. As noted above, the conductors preferably have a rectangular cross-sectional area. When the rings 311, 312, 313, are fitted to the male thread end 310 each of the inwardly extending portions 316 clamps on the end of a respective annular conductors 318. This embodiment could be implemented with axially running conductors disposed in a bore drilled in the wall of the drill string (that is, dispensing with some or all of the liner tube) as previously described.

Figure 14:
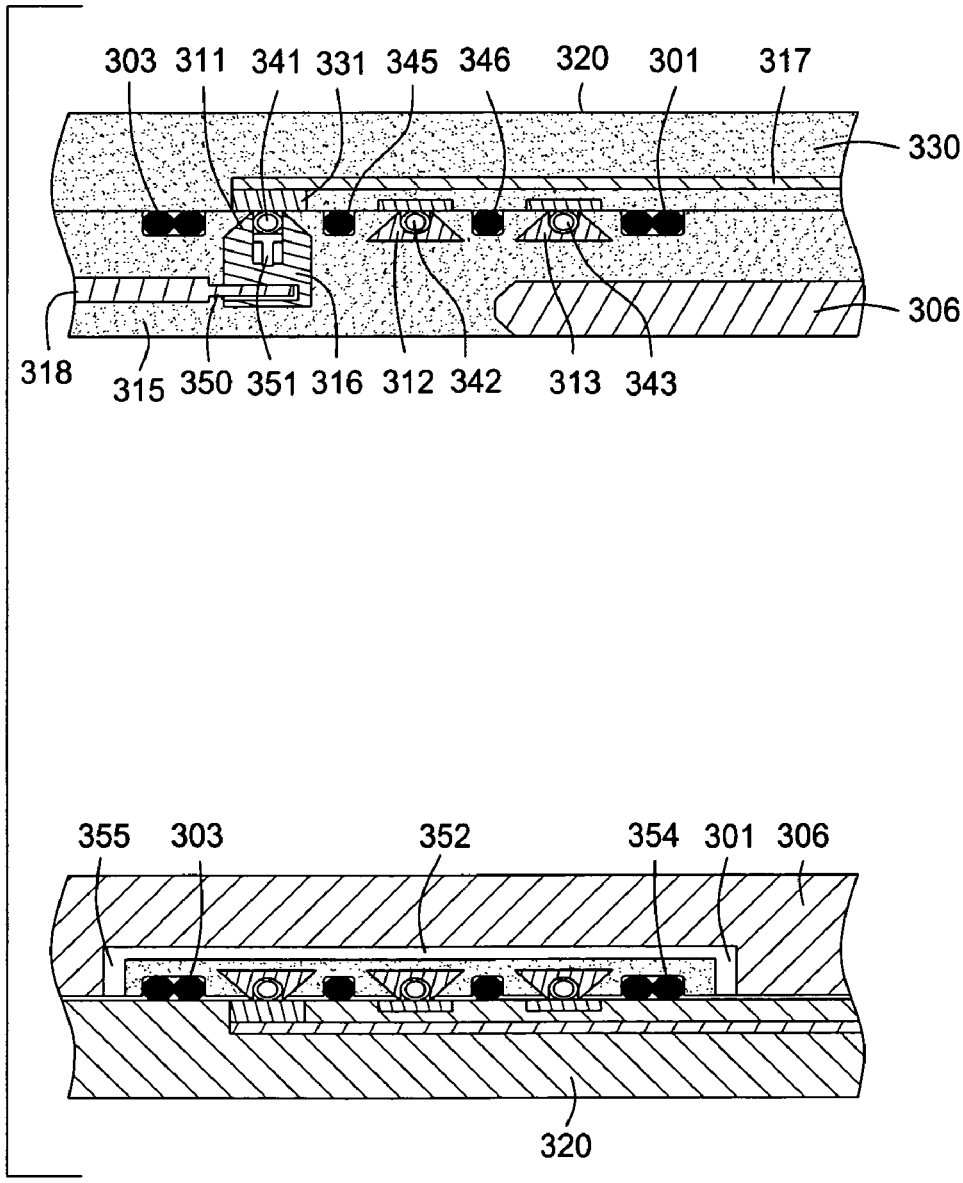
FIG. 14 is a is a section view an embodiment of the conductive rings when engaged.

Referring also to FIG. 14, the outer curved surface of each conductive ring 311, 312, 313 of the male thread end 310 includes an annular groove wherein an outer conductor, or resilient member is disposed. This resilient member may consist of a conductive garter spring 341, 342, 343, so that when the drill pipes are mated, the garter springs also contact the corresponding conductive ring of the joining drill pipe. Consequently, a circuit is formed wherein the electrical power or telemetry data is linked through the garter spring. One advantage to using the spring instead of abutting the contact rings is that the mating tolerances of the drill pipe sections are lessened, allowing for easier make-up. A second advantage is decreased wear on the conductive rings due to less frictional stress occurring during the make-up process.

Two O-ring seals 301, 303 are provided, one fitted forward of the conductive rings on the bypass collar, and one behind the conductive springs on the in an annular groove on the end of the drill pipe section. The bypass collar 306 includes a portion that extends somewhat into the annular region between the drill string and the liner tube, the bypass collar including a bypass channel 352 which communicates, via a radially extending port 354 through the bypass collar 306, with the environment forward of the conductive rings 311, 312, 313 and forward O-ring 301, and, via a radially extending port 355 through the an adjacent part of the drill string, to the environment behind the conductive rings and rear O-ring 303.

Referring again to FIG. 2, the drill pipe section's longitudinal bores 20, 22, 40, 42 ideally run essentially parallel to the drill pipe sections' axes. When two drill pipe sections are undone and are to be remade, the mating threads 14, 16 may not engage to the same position as when they were initially made up. Further, before two separated drill pipe sections are remade, the drill pipe sections' ends may be shortened and/or rethreaded. The male and female connectors 30, 50 will therefore have to be repositioned, and accommodating recesses/profiles in the drill pipe sections have to be re-milled. Turning now to the female threaded end 320 shown in FIG. 12, the liner tube 302 extends along the bore of the drill string section past the internal recess shoulder 321 of the female thread end. Each annular conductor 318 is terminates at a plug 319 adjacent to the internal recess shoulder. The plugs 319 are set in insulating material 323, such as an elastomer. Set into the internal recess shoulder 321 is at least one retaining threaded insert 325.

Shown is a representative female end module, the module being selectively removable. Although not shown, a male end module of a similar nature is also envisioned and included herein. A female thread end module 330 is fitted to the female thread end 320, a portion of the female thread end module 330 inserted to extend between the liner tube 302 and the inner surface of the drill string section 300. The female thread end module 330 includes three sockets 329, which respectively engage with the three plugs 319 connected to the annular conductor 318. At the end of the female thread end module 330 proximal to the female opening, are located three conductive rings 331, 332, 333 having exposed inner surfaces, these rings correspondingly spaced to align with the three conductive rings 311, 312, 313 situated on the male end 310 of the adjacent drill string section. Each of the conductive rings 331, 332, 333 of the female thread end module is electrically connected by conductive lines 317 to the plugs 319. The rings and plugs are set in an insulating material 324. Abutting the edge of the liner tube 318, a sealing member 334 includes o-rings 336 that seal the female thread end module 330 against the liner tube 318. A bore extends through the sealing member and insulating material so that a screw, such as an extended socket head screw 338 engaging with the retaining threaded insert 325 retains the female thread end module 330 in the female thread end. A distance between the conductive rings 331, 332, 333 and the liner tube 302 is provided for the accommodation of the male thread end 310. As described herein, a module connector arrangement facilitates quicker and less expensive rebuilds and repairs.

Figure 13:
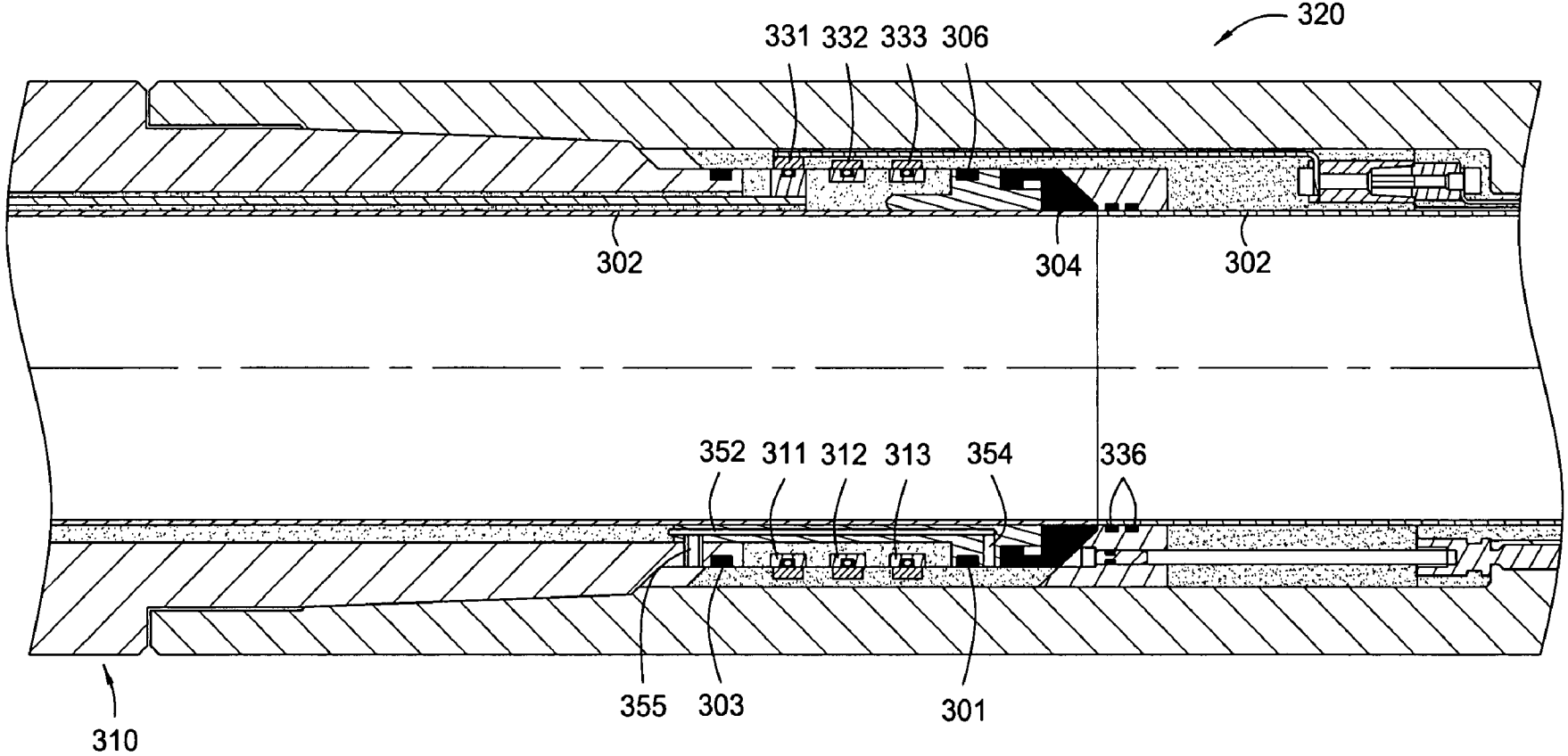
FIG. 13 is a longitudinal sectional view of this embodiment when engaged.

Referring to FIG. 13, when the individual drill pipes are joined, the male threaded portion 310 of one drill string section being inserted into the female threaded portion 320 of an adjacent drill pipe section, the conductive rings 311, 312, 313 of the male threaded end are brought into contact with the conductive rings 331, 332, 333 of the female thread end module 330, the garter springs of the male threaded end pressing against the female thread end module's conductive rings 331, 332, 333 to ensure a good electrical contact is made. As shown, the liner tubes 302 of the two drill pipe sections meet to form a continuous throughbore, although they need not. The electrical components are sealed against the inner bore of the drill string 300 by the o-rings 336 of the female thread end module's sealing member and the nose seal and bypass collar forward o-rings 301 of the male thread end. Similarly, the electrical components are sealed against the environment outside the drill string by the rear o-ring 303 of the male thread end. Non-conductive pipe dope is applied to the threads prior to joining, and some of this pipe dope is retained in a pressurised state in a small volume between the end of the female thread end module 330 the male thread 310 of the adjacent drill pipe. The bypass channel 352 communicates with this volume via one of the bypass ports. It will be seen, in a similar manner to previous embodiments, that the seals 301, 303 forward of and behind the abutting conductive rings can be dispensed with, and that if they are retained and fail, there will not be ingress of fluid between the conductive rings from the surrounding environment.

Referring to FIG. 14, wiper O-rings 345, 346 may be provided between each of the male thread end's conductive rings 311, 312, 313 so that the conductive rings 331, 332, 333 of the female thread end module are wiped clean of pipe dope prior to a connection being made. The O-rings 301, 303 forward and behind the conductive rings (which as shown may be doubled) also perform a wiping function. This figure also shows in more detail the connection rings and the annular conductor. A flat metallic portion 350 extends from the annular conductor 318 into an aperture formed in the radially extending portion 316 of the conductive ring 311. A grub screw 351 then ensures a good electrical contact with the flat portion of the annular conductor 350. The garter spring 341 rests upon the head of the grub screw 351, as well as pressing upon the conductive ring 331 of the female thread end module 330.

Figure 15A:
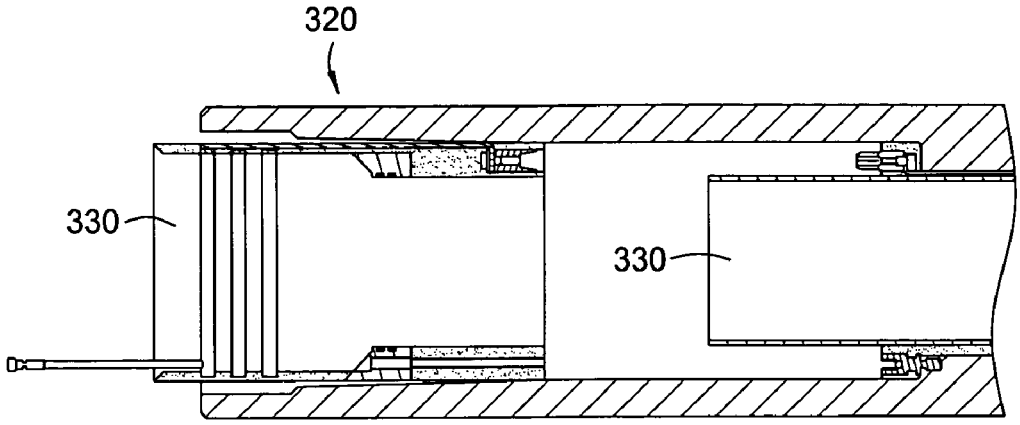
FIG. 15 is a longitudinal sectional view of the previous female end module.
Figure 15B:
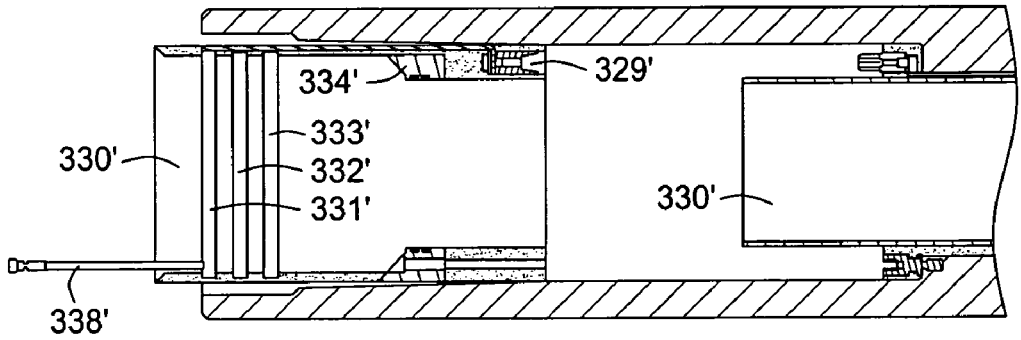
Figure 15C:
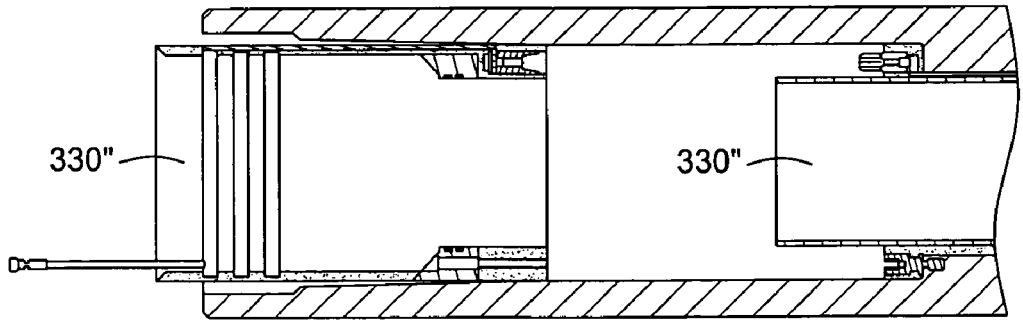

When drill string joints are to be reused, the female thread may be worn and it is often desirable to re-cut the thread. As part of the process, a part of the of the female thread end 320 is removed (typically 2 cm or ¾ of an inch). Referring to FIGS. 15*a* to 15*c*, to accommodate this process, the female thread end module 330 is removed, and the length of the liner tube 302 is reduced by the distance that the female thread end 320 is to be reduced by (or the liner tube 302 is replaced by a correspondingly shorter liner tube.) A new female thread end module 330 having a reduced distance between the socket 329 and the sealing member 334 is then introduced to the female thread end 320, so that the distance between the end of the female thread and the female thread end module's conductive rings 331, 332, 333 remains constant after re-cutting, and may be used as before. The extended socket head screw 338 length is either shortened or replaced with a shorter screw. The female thread end 320 may be re-cut on several occasions, with correspondingly shorter female thread end modules 330 being used after each re-cutting operation. The male thread end may also be re-cut; in this case, the liner tube 302 will again have to be re-sized, the annular conductors 318 shortened and reconnected, and a fresh bypass bore 335 drilled through the male end 310 of the drill pipe section.

Figure 16:
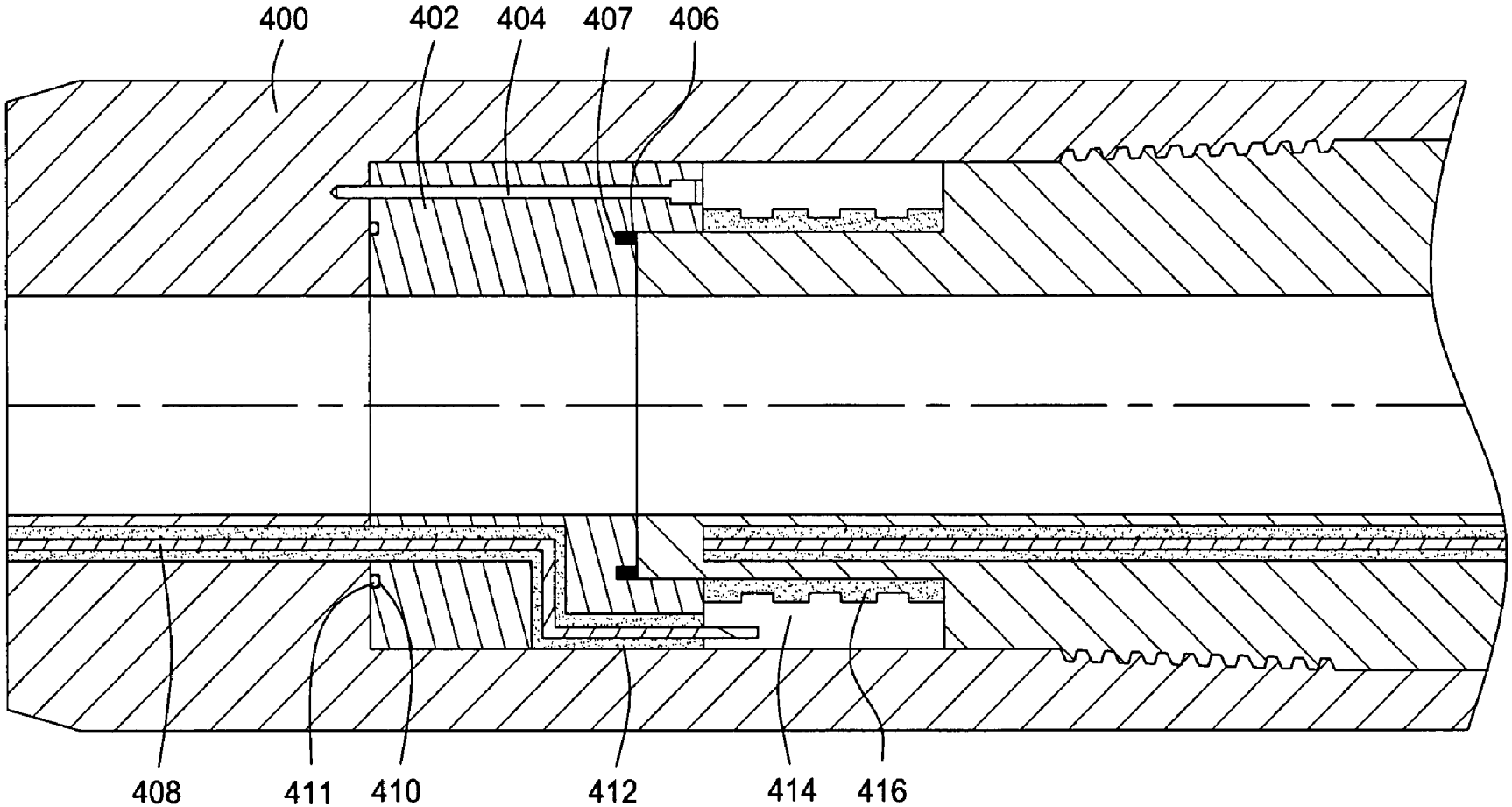
FIG. 16 is a longitudinal sectional view of a further embodiment of two facing ends of adjacent drill pipe sections when engaged.

Referring to FIG. 16, in a modified embodiment, a box sealing carrier 404 is inserted into the box end of the drill pipe 400. The box sealing carrier 404 is preferably metallic in nature, and contains an annular groove 410 on its innermost surface (that is, to the left in the drawing). This annular groove 410 is designed to receive a metal gasket ring 411, such as a type R ring gasket. The box to box sealing carrier connection, with the metallic gasket 411 disposed in between, forms a soft metal seal. The box sealing carrier 404 is preferably attached to the box end of the drill pipe 400 by means of a screw or bolt (numeral 402 referring to a bolt hole or screw cavity). Such attachment method yields to easy removal, repair, and replacement.

As shown, the conductor 408 travels through the bore and through a passageway 412 in the box sealing carrier 404, opening to an annulus 414 proximate to the first conductive ring (ring carrier 416 is shown in the Figure). Also disposed within the box sealing carrier is an annular groove 407 designed to carry an elastomer seal 406 in order to further seal the conductive rings from wellbore fluid. This elastomer seal 406 is referred to as an internal electric contact seal. The internal electric contact seal is located in contact with the box sealing member 404 and the box shoulder or collar area. Preferably too, the internal electric contact seal is capable of being energized to further seal the conductive rings from internal wellbore fluid.

The provision of three conductors means that a three phase power supply may be transmitted down the drill string. Naturally, fewer or further conductive paths may be provided using the principles described herein. In particular, a telemetry wireline may be provided over such a conductive path.

The invention claimed is:

1. A tubular for assembly with a second substantially identical tubular to form a string of tubulars, comprising:

a tubular body having a wall and a main axial bore through the body, the body having a male axial end and a female axial end, the male end configured to mate with a female axial end of the second tubular and the female end configured to mate with a male axial end of the second tubular;

a plurality of conductors, each conductor axially extending between the male end and the female end;

a male connector (MC) disposed in the male end, the MC electrically coupled to each conductor and configured to mate with a female connector (FC) of the second tubular to provide electrical communication between the conductors and respective conductors of the second tubular; and an FC disposed in the female end, the FC electrically coupled to each conductor, and configured to mate with an MC of the second tubular to provide electrical communication between the conductors and respective conductors of the second tubular, wherein:

the MC comprises a metal sealing surface configured to mate with a metal sealing surface of the FC of the second tubular and the FC comprises a metal sealing surface configured to mate with a metal sealing surface of the MC of the second tubular, the metal sealing surfaces, when mated, providing metal to metal seals between electrical components (ECs) of the connectors and main axial bores of the body and a body of the second tubular, and the MC further comprises a nose having the metal sealing surface disposed thereon and the FC further comprises a shoulder having an elastomer seal disposed thereon and the metal sealing surface such that, when the MC mates with the FC of the second tubular, the nose will compress the elastomer seal until the metal sealing surfaces mate and vice versa when the FC mates with the MC of the second tubular.

2. The tubular of claim 1, wherein the body is made from metal and a tip of the male end forms the metal sealing surface and the FC further comprises a shoulder insert having the metal sealing surface formed therein.

3. The tubular of claim 1, wherein the male end and the female end are threaded and a pressure relief valve is disposed in at least one of the ends proximate to the threads.

4. The tubular of claim 1, wherein the body is made from metal, the male end includes a shoulder configured to form a metal to metal seal with a tip of the female end of the second tubular, and a tip of the female end is configured to form a metal to metal seal with a shoulder of the male end of the second tubular.

5. The tubular of claim 1, wherein the FC is coupled to the female end with a threaded fastener.

6. The tubular of claim 1, wherein the male connector (MC) further comprises a plurality of ECs, each EC of the MC electrically coupled to a respective conductor and the FC further comprises a plurality of ECs, each EC electrically coupled to a respective conductor.

7. The tubular of claim 6, wherein the ECs comprise conductive rings.

8. The tubular of claim 6, wherein at least one of the MC and the FC further comprises a bypass duct communicating between a first axial location and a second axial location and the ECs are disposed between the two axial locations.

9. The tubular of claim 1, wherein the wall has a plurality of secondary axial bores formed through at least a portion thereof, each conductor disposed in each secondary bore.

10. The tubular of claim 9, wherein a centerline of the main bore and a centerline of each secondary bore are substantially parallel.

11. The tubular of claim 9, further comprising a resilient tube disposed in at least a portion of each secondary bore.

12. The tubular of claim 1, further comprising a metal sleeve disposed along an inner surface of the wall, the conductors disposed along an inner surface of the sleeve and encased in an insulating material.

13. The tubular of claim 12, wherein the aspect ratio of each of the conductors is not equal to one.

14. The tubular of claim 12, wherein the conductors are substantially rectangular in cross-section.

15. The tubular of claim 14, wherein the conductors are disposed along a common radial axis.

16. A tubular for assembly with a second substantially identical tubular to form a string of tubulars, comprising:

a tubular body having a wall and an axial bore through the body, the body having a male axial end and a female axial end, the male end configured to mate with a female axial end of the second tubular and the female end configured to mate with a male axial end of the second tubular;

a plurality of conductors, each conductor axially extending between the male end and the female end;

a male connector (MC) comprising a plurality of electrical components (ECs), a protrusion, a recess, and a wiper disposed in the recess, the MC disposed in the male end, each EC electrically coupled a respective conductor, the MC configured to mate with a female connector (FC) of the second tubular to provide electrical communication between the conductors and respective conductors of the second tubular; and an FC comprising a plurality of electrical components (ECs), a protrusion, a recess, and a wiper disposed in the recess, the FC disposed in the female end, each EC electrically coupled a respective conductor, the FC configured to mate with an MC of the second tubular to provide electrical communication between the conductors and respective conductors of the second tubular, wherein:

each wiper is actuatable between a first position and a second position, the wiper of the MC covers the ECs of the MC in the first position, the MC configured so that when the MC mates with the FC of the second tubular, a protrusion of the FC of the second tubular will actuate the wiper to a second position, where the ECs will no longer be covered and, during actuation, the wiper will wipe the ECs of the MC, and the wiper of the FC covers the ECs of the FC in the first position, the FC configured so that when the FC mates with the MC of the second tubular, a protrusion of the MC of the second tubular will actuate the wiper to a second position, where the ECs will no longer be covered and, during actuation, the wiper will wipe the ECs of the FC.

17. The tubular of claim 16, wherein each wiper is coupled to each connector by a biasing member.

18. A tubular for assembly with a second substantially identical tubular to form a string of tubulars, comprising:

a tubular body having a wall and an axial bore through the body, the body having a male axial end and a female axial end, the male end configured to mate with a female axial end of the second tubular and the female end configured to mate with a male axial end of the second tubular;

a plurality of conductors, each conductor axially extending between the male end and the female end;

a male connector (MC) comprising a plurality of electrical components (ECs) and disposed in the male end, each EC electrically coupled a respective conductor, the MC configured to mate with a female connector (FC) of the second tubular to provide electrical communication between the conductors and respective conductors of the second tubular; and an FC comprising a plurality of ECs and disposed in the female end, each EC electrically coupled a respective conductor, the FC configured to mate with an MC of the second tubular to provide electrical communication between the conductors and respective conductors of the second tubular, wherein:

the FC is coupled to the female end with a threaded fastener, coupled to each conductor with a plug and socket connection, and is otherwise configured so that, when the fastener is removed, the FC may be removed by applying a tensile force to unfasten the plug and socket connections, and the ECs of one of the MC and the FC comprise contact rings having a biasing member disposed therein and the ECs of the other of the MC and the FC comprise contact rings so that both the contact ring and the biasing member of the one of the MC and the FC will contact the contact rings of the other of the MC and the FC of the second tubular.

19. The tubular of claim 18, wherein the MC further comprises an elastomeric nose seal, the nose seal having an inclined sealing surface and the FC further comprises a sealing member having an inclined surface, the inclined surface of the nose seal configured to mate with an inclined surface of a sealing member of the FC of the second tubular, and the inclined surface of the sealing member of the FC configured to mate with a nose seal of the MC of the second tubular, the resulting seals isolating the ECs from axial bores of the body and a body of the second tubular.

20. The tubular of claim 18, wherein at least one of the MC and the FC further comprises a bypass duct communicating between a first axial location and a second axial location and the ECs are disposed between the two axial locations.

21. A tubular for assembly with a second substantially identical tubular to form a string of tubulars, comprising:

a tubular body having a wall and an axial bore through the body, the body having a male axial end and a female axial end, the male end configured to mate with a female axial end of the second tubular and the female end configured to mate with a male axial end of the second tubular;

a plurality of conductors, each conductor axially extending between the male end and the female end;

a male connector (MC) comprising a plurality of electrical components (ECs) and disposed in the male end, each EC electrically coupled a respective conductor, the MC configured to mate with a female connector (FC) of the second tubular to provide electrical communication between the conductors and respective conductors of the second tubular; and an FC comprising a plurality of ECs and disposed in the female end, each EC electrically coupled a respective conductor, the FC configured to mate with an MC of the second tubular to provide electrical communication between the conductors and respective conductors of the second tubular, wherein:

the FC is coupled to the female end with a threaded fastener, coupled to each conductor with a plug and socket connection, and is otherwise configured so that, when the fastener is removed, the FC may be removed by applying a tensile force to unfasten the plug and socket connections, and the MC further comprises an elastomeric nose seal, the nose seal having an inclined sealing surface and the FC further comprises a sealing member having an inclined surface, the inclined surface of the nose seal configured to mate with an inclined surface of a sealing member of the FC of the second tubular, and the inclined surface of the sealing member of the FC configured to mate with a nose seal of the MC of the second tubular, the resulting seals isolating the ECs from axial bores of the body and a body of the second tubular.

22. A tubular for assembly with a second substantially identical tubular to form a string of tubulars, comprising:

a tubular body having a wall and an axial bore through the body, the body having a male axial end and a female axial end, the male end configured to mate with a female axial end of the second tubular and the female end configured to mate with a male axial end of the second tubular;

a plurality of conductors, each conductor axially extending between the male end and the female end;

a male connector (MC) comprising a plurality of electrical components (ECs) and disposed in the male end, each EC electrically coupled a respective conductor, the MC configured to mate with a female connector (FC) of the second tubular to provide electrical communication between the conductors and respective conductors of the second tubular; and an FC comprising a plurality of ECs and disposed in the female end, each EC electrically coupled a respective conductor, the FC configured to mate with an MC of the second tubular to provide electrical communication between the conductors and respective conductors of the second tubular, wherein:

the FC is coupled to the female end with a threaded fastener, coupled to each conductor with a plug and socket connection, and is otherwise configured so that, when the fastener is removed, the FC may be removed by applying a tensile force to unfasten the plug and socket connections, and at least one of the MC and the FC further comprises a bypass duct communicating between a first axial location and a second axial location and the ECs are disposed between the two axial locations.

23. A tubular for assembly with a second substantially identical tubular to form a string of tubulars, comprising:

a tubular body having a wall and a main axial bore through the body, the body having a male axial end and a female axial end, the male end configured to mate with a female axial end of the second tubular and the female end configured to mate with a male axial end of the second tubular;

a plurality of conductors, each conductor axially extending between the male end and the female end;

a male connector (MC) disposed in the male end, the MC electrically coupled to each conductor and configured to mate with a female connector (FC) of the second tubular to provide electrical communication between the conductors and respective conductors of the second tubular; and an FC disposed in the female end, the FC electrically coupled to each conductor, and configured to mate with an MC of the second tubular to provide electrical communication between the conductors and respective conductors of the second tubular, wherein:

the MC comprises a metal sealing surface configured to mate with a metal sealing surface of the FC of the second tubular and the FC comprises a metal sealing surface configured to mate with a metal sealing surface of the MC of the second tubular, the metal sealing surfaces, when mated, providing metal to metal seals between electrical components (ECs) of the connectors and main axial bores of the body and a body of the second tubular, the male connector (MC) further comprises a plurality of ECs, each EC of the MC electrically coupled to a respective conductor and the FC further comprises a plurality of ECs, each EC electrically coupled to a respective conductor, and at least one of the MC and the FC further comprises a bypass duct communicating between a first axial location and a second axial location and the ECs are disposed between the two axial locations.

24. A tubular for assembly with a second substantially identical tubular to form a string of tubulars, comprising:

a tubular body having a wall and a main axial bore through the body, the body female axial end of the second tubular and the female end configured to mate with a male axial end of the second tubular, the wall having a plurality of secondary axial bores formed through at least a portion thereof;

a plurality of conductors, each conductor axially extending between the male end and the female end and disposed in each secondary bore;

a resilient tube disposed in at least a portion of each secondary bore;

a male connector (MC) disposed in the male end, the MC electrically coupled to each conductor and configured to mate with a female connector (FC) of the second tubular to provide electrical communication between the conductors and respective conductors of the second tubular; and an FC disposed in the female end, the FC electrically coupled to each conductor, and configured to mate with an MC of the second tubular to provide electrical communication between the conductors and respective conductors of the second tubular, wherein the MC comprises a metal sealing surface configured to mate with a metal sealing surface of the FC of the second tubular and the FC comprises a metal sealing surface configured to mate with a metal sealing surface of the MC of the second tubular, the metal sealing surfaces, when mated, providing metal to metal seals between electrical components (ECs) of the connectors and main axial bores of the body and a body of the second tubular.

25. A tubular for assembly with a second substantially identical tubular to form a string of tubulars, comprising:

a tubular body having a wall and a main axial bore through the body, the body having a male axial end and a female axial end, the male end configured to mate with a female axial end of the second tubular and the female end configured to mate with a male axial end of the second tubular;

a plurality of conductors, each conductor axially extending between the male end and the female end;

a male connector (MC) disposed in the male end, the MC electrically coupled to each conductor and configured to mate with a female connector (EC) of the second tubular to provide electrical communication between the conductors and respective conductors of the second tubular; and an FC disposed in the female end, the FC electrically coupled to each conductor, and configured to mate with an MC of the second tubular to provide electrical communication between the conductors and respective conductors of the second tubular, wherein:

the MC comprises a metal sealing surface configured to mate with a metal sealing surface of the FC of the second tubular and the FC comprises a metal sealing surface configured to mate with a metal sealing surface of the MC of the second tubular, the metal sealing surfaces, when mated, providing metal to metal seals between electrical components (ECs) of the connectors and main axial bores of the body and a body of the second tubular, and the male end and the female end are threaded and a pressure relief valve is disposed in at least one of the ends proximate to the threads.

26. A tubular for assembly with a second substantially identical tubular to form a string of tubulars, comprising:

a tubular body having a wall and a main axial bore through the body, the body having a male axial end and a female axial end, the male end configured to mate with a female axial end of the second tubular and the female end configured to mate with a male axial end of the second tubular;

a metal sleeve disposed along an inner surface of the wall, the conductors disposed along an inner surface of the sleeve and encased in an insulating material;

a male connector (MC) disposed in the male end, the MC electrically coupled to each conductor and configured to mate with a female connector (FC) of the second tubular to provide electrical communication between the conductors and respective conductors of the second tubular; and an FC disposed in the female end, the FC electrically coupled to each conductor, and configured to mate with an MC of the second tubular to provide electrical communication between the conductors and respective conductors of the second tubular, wherein the MC comprises a metal sealing surface configured to mate with a metal sealing surface of the FC of the second tubular and the FC comprises a metal sealing surface configured to mate with a metal sealing surface of the MC of the second tubular, the metal sealing surfaces, when mated, providing metal to metal seals between electrical components (ECs) of the connectors and main axial bores of the body and a body of the second tubular.

27. The tubular of claim 26, wherein the aspect ratio of each of the conductors is not equal to one.

28. The tubular of claim 26, wherein the body is made from metal and a tip of the male end forms the metal sealing surface and the FC further comprises a shoulder insert having the metal sealing surface formed therein.

29. The tubular of claim 26, wherein the male end and the female end are threaded and a pressure relief valve is disposed in at least one of the ends proximate to the threads.

30. The tubular of claim 26, wherein the body is made from metal, the male end includes a shoulder configured to form a metal to metal seal with a tip of the female end of the second tubular, and a tip of the female end is configured to form a metal to metal seal with a shoulder of the male end of the second tubular.

31. The tubular of claim 26, wherein the FC is coupled to the female end with a threaded fastener.

32. The tubular of claim 26, wherein the conductors are substantially rectangular in cross-section.

33. The tubular of claim 32, wherein the conductors are disposed along a common radial axis.

34. The tubular of claim 26, wherein the male connector (MC) further comprises a plurality of ECs, each EC of the MC electrically coupled to a respective conductor and the FC further comprises a plurality of ECs, each EC electrically coupled to a respective conductor.

35. The tubular of claim 34, wherein the ECs comprise conductive rings.

36. The tubular of claim 34, wherein at least one of the MC and the FC further comprises a bypass duct communicating between a first axial location and a second axial location and the ECs are disposed between the two axial locations.

37. A tubular for assembly with a second substantially identical tubular to form a string of tubulars, comprising:

a tubular body having a wall and a main axial bore through the body, the body having a male axial end and a female axial end, the male end configured to mate with a female axial end of the second tubular and the female end configured to mate with a male axial end of the second tubular;

a plurality of conductors, each conductor axially extending between the male end and the female end;

a male connector (MC) disposed in the male end, the MC electrically coupled to each conductor and configured to mate with a female connector (FC) of the second tubular to provide electrical communication between the conductors and respective conductors of the second tubular; and an FC disposed in the female end and coupled to the female end with a threaded fastener, the FC electrically coupled to each conductor, and configured to mate with an MC of the second tubular to provide electrical communication between the conductors and respective conductors of the second tubular, wherein the MC comprises a metal sealing surface configured to mate with a metal sealing surface of the FC of the second tubular and the FC comprises a metal sealing surface configured to mate with a metal sealing surface of the MC of the second tubular, the metal sealing surfaces, when mated, providing metal to metal seals between electrical components (ECs) of the connectors and main axial bores of the body and a body of the second tubular.

* * * * *

UNITED STATES PATENT AND TRADEMARK OFFICE

CERTIFICATE OF CORRECTION

PATENT NO. : 7,114,970 B2
APPLICATION NO. : 10/482061
DATED : October 3, 2006
INVENTOR(S) : Philip Head It is certified that error appears in the above-identified patent and that said Letters Patent is hereby corrected as shown below:

In the Claims:

In Column 16, Claim 24, Line 50, please delete "body female" and insert --body having a male axial end and a female axial end, the male end configured to mate with a female--;

In Column 17, Claim 26, between Line 58 and Line 59, please insert --a plurality of conductors, each conductor axially extending between the male end and the female end;--.

Signed and Sealed this

Third Day of July, 2007

JON W. DUDAS
*Director of the United States Patent and Trademark Office*